US008106369B2

(12) United States Patent
Drenter

(10) Patent No.: US 8,106,369 B2
(45) Date of Patent: Jan. 31, 2012

(54) ELECTRON BEAM WEB IRRADIATION APPARATUS AND PROCESS

(75) Inventor: John Drenter, Davenport, IA (US)

(73) Assignee: PCT Engineered Systems, LLC, Davenport, IA (US)

( * ) Notice: Subject to any disclaimer, the term of this patent is extended or adjusted under 35 U.S.C. 154(b) by 410 days.

(21) Appl. No.: 12/401,269

(22) Filed: Mar. 10, 2009

(65) Prior Publication Data

US 2010/0230618 A1 Sep. 16, 2010

(51) Int. Cl.
*B05D 3/06* (2006.01)

(52) U.S. Cl. ..... 250/492.3; 250/515.1

(58) Field of Classification Search ..... 250/492.1, 250/492.3; 427/345, 496; 264/1.34
See application file for complete search history.

(56) References Cited

U.S. PATENT DOCUMENTS 4,252,413 A 2/1981 Nablo
4,521,445 A * 6/1985 Nablo et al. ..... 427/496
4,610,956 A * 9/1986 Fuchizawa et al. ..... 430/538
4,642,244 A 2/1987 Tripp, III et al.
4,933,120 A * 6/1990 D'Amato et al. ..... 264/1.34
5,003,915 A * 4/1991 D'Amato et al. ..... 118/46
5,083,850 A * 1/1992 Mallik et al. ..... 359/1
5,116,548 A * 5/1992 Mallik et al. ..... 264/1.34
5,194,742 A * 3/1993 Avnery et al. ..... 250/492.3
6,455,152 B1 * 9/2002 DiZio et al. ..... 428/345
6,504,165 B1 1/2003 Furutoh
6,727,508 B1 4/2004 Tominaga et al.
6,743,469 B2 * 6/2004 DiZio et al. ..... 427/207.1
6,930,315 B2 * 8/2005 Tominaga et al. ..... 250/492.1
7,348,578 B2 3/2008 Naslund et al.
7,435,980 B2 10/2008 Nakao

OTHER PUBLICATIONS

DiZio, James and Weiss, Douglas, "E-Beam Drum Transfer: Process to Electron Irradiate A PSA in the Absence of a Backing", Pressure Sensitive Tape Council, Northbrook, IL, 2003.

* cited by examiner

*Primary Examiner* — Nikita Wells
*Assistant Examiner* — Johnnie Smith
(74) *Attorney, Agent, or Firm* — Woodard, Emhardt, Moriarty, McNett & Henry LLP

(57) ABSTRACT

The present disclosure includes an electron beam emitter, a roller for a web, circumferential radiation shielding, a reaction chamber, movement between open and closes positions, a depositor, baffles, inert gas dispenser, and other features. One example in the present disclosure is a web carrying roller for electron beam irradiation of the web on one side of that roller within a baffle-containing shielded area, while another side of that roller is outside of the shielded area, and near the two ends of the roller are arcuate tongue and groove barriers to x-radiation leakage from the shielded area. The baffle-containing shielded area has a series of voids separated by walls, rather than having the shielded area positioned close to the circumference of the cylinder along its length.

44 Claims, 27 Drawing Sheets

ELECTRON BEAM WEB IRRADIATION APPARATUS AND PROCESS

FIELD OF INVENTION

The present invention relates to electron beams, and more specifically to an apparatus and process for exposing a web to an electron beam.

BACKGROUND

There are many electron beam apparatuses in operation world wide. They produce accelerated electrons that ionize some materials. This ionization can be useful in a various processes, including as examples, chemical processes that include cross-linking of polymers and/or polymerization of polymer precursors. Other processes and uses are available as well. The electrons also result in the generation of secondary radiation. These may, depending of several factors, be harmful to people and may degrade parts, materials and lubricants.

Electron beam apparatuses may be used to process webs. The webs pass into a reaction chamber for exposure. These machines and operations can be expensive, and it is desirable to improve their operation, reduce wear, improve serviceability, maintain operator safety, and/or improve energy usage. Various optional features herein, alone or in combination, may address one or more of these considerations.

SUMMARY

The claims, and only the claims, define the invention. The present invention includes several, but not necessarily all, of an electron beam emitter, a roller for a web, circumferential radiation shielding, a reaction chamber, movement between open and closed positions, a depositor, baffles, inert gas dispenser, and other features, optionally combined in various ways as set forth in the claims.

BRIEF DESCRIPTION OF THE PREFERRED EMBODIMENTS

Figure 1:
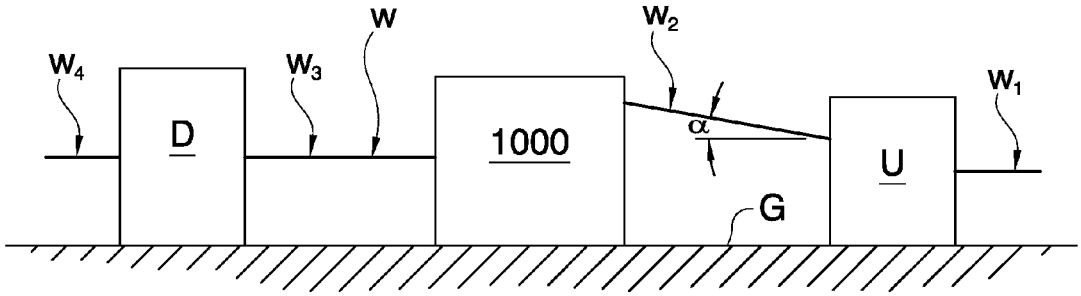
FIG. 1 is a diagrammatic view of one of example of the present invention.

For the purposes of promoting an understanding of the principles of the invention, reference will now be made to the examples, sometimes referred to as embodiments, illustrated and/or described herein. Those are mere examples. It will nevertheless be understood that no limitation of the scope of the invention is thereby intended. Such alterations and further modifications in the described processes, systems or devices, any further applications of the principles of the invention as described herein, are contemplated as would normally occur to one skilled in the art to which the invention relates, now and/or in the future in light of this document.

As used in the claims and the specification, the following terms have the following definitions:

The term "arc of a circumference" is a curved portion, something less than a full 360 degree circle, generally around the circumferential direction of a circumference.

The term "axially" means, with respect to a roller, a direction either directly along and/or parallel to the central axis of the cylinder and/or roller.

The term "axially outboard" means in a direction, taken in an axial direction, away from or outside of the relative central region of a cylinder.

The term "bearing" means a mechanical support that allows rotation. This would include, but not be limited to ball bearings, roller bearings, tapered roller bearings, simple bearings, bushings, sleeve bearings, rifle bearings, lubricated fittings, fluid bearings, magnetic bearings, or otherwise, alone or in combination.

The term "circumference" is the path around a roller along a curved line substantially equidistant from the roller's central axis, in a plane perpendicular to the central axis, or a similar path around a groove or ridge in a roller used for shielding, or the path of a curved line or curved line segment around a curved mating part for such a groove or ridge.

The term "close proximity" is a relative term meaning close enough to cause a narrow enough gap, in view of the gap width and other geometry, to substantially reduce the level and/or energy of radiation to a satisfactory level.

The term "coolant fluid" means a fluid, either liquid or gas, used to absorb heat for cooling purposes. This can include, but is not limited to, water, air, or any other suitable solution or chemical.

The term "coolant inlet" means a structure, such as a conduit, pipe, tube, hose, hole or gap though a part or parts, or path, allowing the flow of coolant into something else.

The term "coolant outlet" means a structure, such as a conduit, pipe, tube, hose, hole or gap though a part or parts, or path, allowing the flow of coolant out from something else.

The term "cylindrical roller" means a roller which is cylindrical in overall shape. Its meaning includes a single cylindrical roller that can be rotated about its central axis.

The term "cylindrical surface" means a surface, or a series, group or pattern, of closely related surfaces, generally in a geometric cylindrical shape. This includes not only a mirror smooth surface, and also other surfaces in the general shape of a cylinder, including such surfaces with roughening, ribs and/or grooves, mesh, and otherwise. The surface may be solid or porous. A series of several adjacent smaller rollers arranged in a curved pattern would be one example of a cylindrical surface, as the term is meant herein. A cylindrical surface does not need to be rotatable and does not need to include the entire circumference of a cylinder, but in the preferred embodiment it does, as a part of the cylindrical roller.

The term "deepest point", in the context of a groove, is the lowest point relative to the reference surface from which the groove is made. In the context of a cylindrical surface as such reference surface, the deepest point would be radially inward or outward, towards or away from the central axis of a cylindrical shape, such as a roller. In the context of a flat surface as the reference, such as for example, the side of a roller, the deepest point would be axially inward or outward.

The term "depositor" means one or more machines, devices, or apparatus that deposits material onto a web. This can include printing, coating and both. Printing generally refers to the application of a defined pattern of graphics and/or text. Coating(s) can cover only a portion, or cover most or cover all of the web. Printing and coatings may be decorative and/or functional in nature. Functional materials may include various types of adhesives. Application methods for printing and/or coating include various types of roll, inkjet, spray, or other methods. This can include, but is not limited to, deposition of liquid material, gelatinous material, powder material, laminates, decals, or otherwise. This can include, but is not limited to depositing material via another web or backing which may (or may not) be later removed. Various types of embossing may also be applied to printing, coating, and/or the web itself. The depositor may include multiple application stations in order to provide multiple layers, multiple colors, and defined patterns. One or more layers may be effectively cured by electron beam irradiation or may be partially or completely cured or dried by other methods prior to electron beam irradiation.

The term "double back" means to substantially reverse direction.

The term "downstream" means a relative direction down or later in the path of the web movement.

The term "driver" means a mechanical driver that imparts force, directly or indirectly, with or without intermediate parts or elements, for rotation. This may include, but is not limited to, motors (electric, pneumatic, hydraulic, or otherwise), a drive chain and sprocket, gears, bevel gears, web-roller engagement, drive shaft, belt and pulleys, or otherwise, alone or in combination.

The term "electron beam emitter" means one or more device or a component that emits electron beams. It may be high energy and/or low energy, and is typically used in industrial or commercial applications. It may be, only by way of example: curtain type equipment where the width of the electron gun and its associated filaments define the width of the processing zone; scanning type equipment where an oscillating electrical field is used to raster a narrow electron beam thereby defining the processing zone; a combination thereof, or otherwise. It may include one or more electron generator or accelerator. It can be any power level and typically is in the range of 50 kV to 10,000 kV (10 MeV), with from 60 kV to 300 kV being more preferred, and 70 to 150 kV being most preferred.

The term "engages" means mechanical contact, directly, indirectly, or both, with or without intermediate parts or elements, between parts.

The term "frame" means any mechanical support structure, regardless of the number or parts or arrangement. It may be made of separate sub-frames or it may be a unitary assembly. It may be fixed, movable, or both. It may be made of, in whole or in part, and as mere examples, of plates, bars, beams, joists, angle stock, I-beam stock, T-beam stock, rods, trusses, pipes, tubes, connectors, screws, bolts, rivets, welding, or otherwise, or a combination thereof.

The term "free of contact" means without mechanical touching.

The term "gas barrier" means one or more of solid structure or surface which is totally or substantially impervious to gas, and which may (or may not) include radiation shielding.

The term "groove" means a recess, relative to a reference surface, that is longer than it is wide. The length of a groove may be straight or curved, such as for example around a circumference or an arc of a circumference.

The term "inert gas" means a gas that is substantially non-reactive with electron beams and/or radiation, particularly in terms of reactions that generate ozone or other gas or by-product that is corrosive or toxic. Examples of an inert gas may include, but is not limited to helium, argon, krypton, neon, and nitrogen, as well as mixtures thereof.

The term "inert gas dispenser" means a nozzle, hole, slot, hose, conduit, bar, rod, element, manifold, alone or in combination, whether singular, in series or parallel, out of which inert gas comes.

The term "internal baffles" are walls or combinations of walls within the reaction chamber and which substantially absorb, block, and/or fluoresce lower energy radiation. Internal baffles may be, but are not necessarily configured to combine two or three such walls to create rectangular and/or cuboidal corner radiation reflectors. Baffles may likewise be curvilinear and/or a combination thereof, and may have smooth surfaces, roughened surfaces, or may contain many cuboidal corner reflectors on its surface, or otherwise, or not.

The term "operator access" means space sufficient for a human operator to get at least their hands and arms into a space to perform work, such as servicing, part replacement, or otherwise.

The term "overall angular slope" means the average or net angle of inclination or declination in the web between two points of contact, such as for example, between two rollers and/or two stations along a portion of the path of the web.

The term "path" means the route followed, such as the route followed by a web upstream of, through, to or away from, the apparatus of the present invention, and downstream thereof, or a portion thereof. The path may be straight, curved or otherwise. The path may be directed around rollers or otherwise.

The term "plane of window" means the general two-dimensional geometric plane that best coincides with the geometry of the window. If the window is curved, then the plane of window means the two-dimensional geometric plane most closely approximating it.

The term "radiation shielding" means one or more layers, mesh, and/or other structures which substantially contain or de-energize radiation (by absorption, blocking and/or fluorescence that produces lower energy radiation, or otherwise) directly or indirectly from an electron beam generator. Such radiation includes x-rays and related radiation resulting from electron beam generators. Radiation shielding may be a variety of materials, alone or in combination, including without limitation lead, steel, tungsten, and depleted uranium. Other less preferred shielding materials can also be used, such as copper, aluminum, titanium, glass (e.g. lead containing glass), titanium, or polymers (e.g. polyethylene or polyurethane). Shielding materials can optionally be dispersed in a plastic carrier, or laminated, with or without other backing or reinforcement. The thickness and material(s) selection may be varied to suit various energy levels.

The term "reaction chamber" means a three-dimensional space substantially defined by radiation shielding in which the web is exposed to electron beams and/or radiation. Usually, the web is directly in the path of electrons as they emerge from the electron beam emitter within the reaction chamber.

The term "roller" means a structure or collection of structures that can be rotated to allow a web to pass through the reaction chamber. This may include, but is not limited to, a cylindrical roller. A roller may be a cylindrical roller, such as a single cylindrical roller. Optionally, a roller need not be a single or monolithically rotating unit. Optionally, it may include a series of smaller rollers or ball bearings mounted in a curved and/or flat array. Preferably, and in at least in some examples, such smaller rollers may, but would not necessarily have to have, circumferential radiation shielding around one or more of them, in particularly insofar as part of them is within the reaction chamber. Optionally, in such situation, the radiation shielding corresponding to this form of roller arrangement may be part of such smaller rollers and/or be part of another surface underlying such an array of rollers. Such array of rollers may or may not be cooled with a coolant fluid. Optionally, such arrangement allows for bearings and/or other mechanical features associated with the smaller rollers to the outside of the reaction chamber.

The term "seal" means one or more parts, or a geometric interrelationship, or both, that substantially blocks or at least impedes the flow of fluids across it/them. This can include, but is not limited to, O-rings, washers, gaskets, frusto-conical interfaces, tongue and groove interfaces, and/or other tortured paths, bushings, and/or a combination of the foregoing.

The term "shallowest point" means in the context of a groove, the highest point coinciding with the reference surface from which the groove is made. In the context of a cylindrical surface, the shallowest point would be radially at the cylindrical surface.

The term "sloping sides", in the context of grooves, means a side wall of the groove sloping, at least in part, in both a radial direction and an axial direction.

The term "stationary conduit" means is a structure, such as a conduit, pipe, tube, hose or otherwise allowing the flow of coolant, that does not rotate.

The term "substantially containing or de-energizing radiation" means to prevent radiation from escaping in an amount and/or at an energy level that would be unsuitable for safety concerns.

The term "substantially horizontal" means more horizontal than vertical, namely between inclination less than 45 degrees and a declination greater than negative 45 degrees with respect to gravity.

The term "substantially vertical" means vertical more than horizontal, namely between an inclination greater than 45 degrees and a declination less than negative 45 degrees with respect to gravity.

The term "supported for rotation" means mechanically supported in terms of holding some or all of the weight of an object, such as a roller and/or its contents, and allowing rotation with respect to the support. This would include, but not be limited to, bearings.

The term "surface that tapers" means, in the context of a groove on a cylinder, a surface or surfaces that effectively runs both axially as well as radially towards the deepest point of the groove, whether or not the surface is sloped in whole or in part. This may include one or more sloped-side segments, one or more stair-stepped segments, curved segments, straight segments, radial segments, axial segments, and/or a combination thereof.

The term "switch" means a mechanical, electromechanical and/or optical device which can either interrupt or connect an electrical circuit and/or sends a signal to a relay or other control device which interrupts or connects an electrical circuit.

The term "tangent point" means a location or locations, at or near the perimeter of either a circle or the circular shape of a cylindrical surface. In the context of a roller this would include some or all of a line running axially along the cylindrical surface of the roller.

The term "tongue and groove interface" means a geometric relationship in which one or more tongue(s) protrudes at least partially into one or more groove(s). They may be in contact, not in contact, and/or in close proximity with each other, and preferably, but not necessarily, are in close proximity. They may have corresponding, albeit slightly different sized geometric profiles or cross-sections, albeit, of any of a variety shapes and geometries, and alternatively they may have different geometric profiles or cross-sections. A tongue and groove interface can include one or more of a first tongue and a second groove on first element(s) with a first groove and a second tongue on the corresponding element(s). Moreover, a tongue and groove interface may include one or multiple tongues and grooves.

The term "track" means rail, groove, both, or other structure along which another member may ride, roll, slide or move, with or without rollers, wheels or casters. Multiple tracks may be parallel to each other.

The term "up stream" means a relative direction before or earlier in the path of the web movement.

The term "uncured material" is material which has not been irradiated by the electron beam emitter.

The term "under" means beneath something with respect to gravity.

The term "voids" are spaces between internal baffles comprising radiation shielding.

The term "web" is an elongated, comparatively thin, strip of material. It may be made of a variety of materials, alone or in combination, including transparent, translucent, and/or opaque plastic, film or other polymer, cloth, foil, paper, blends, metal, metal alloys, or otherwise. A web may be a single layer or multiple layers and may include porous or mesh like structures and/or may include non-porous material. A web ordinarily is flexible; however it may also be semi-flexible or relatively stiff. When stiff, and wrapped around a roller, typically sufficient force is used to yield the web around a roller (ordinarily within elastic limits unless, optionally, the roller is also used for plastic deformation of the web). A web can also include narrow materials in the nature of a ribbon or band as well as strands, cords, and/or wires, alone or in parallel with each other. The foregoing materials may also be held, bonded to, or otherwise carried by a carrier layer.

The term "window" means the location where the electron beams from the electron beam emitter enter the reaction chamber. This may take a variety of forms. It may comprise a structure, assembly, foil and/or layers located at the output of an electron beam generator and near the roller which is substantially transmissive of electron beams and/or radiation. A window is typically substantially impervious to gas, and is typically includes a thin foil supported by a framework, preferably a cooled framework.

Articles and phases such as, "the", "a", "an", "at least one", and "a first", are not limited to mean only one, but rather are inclusive and open ended to also include, optionally, multiple such elements.

Referring to the drawing figures, these are only examples of the invention, and the invention is not limited to what is shown in the drawings.

FIG. 1 shows apparatus 1000. Optionally, a process and system may have an upstream apparatus U and a downstream apparatus D. Alternatively, apparatus 1000 and/or method of its use do not require one or both of these upstream or down stream apparatus. However, for example, upstream apparatus U may optionally be a depositor for web W. Alternatively, apparatus 1000 may be used without any depositor, such as by way of example to cross link polymers, treating a web, or otherwise. Further, more that one depositors and more than one apparatuses like apparatus 1000 may optionally be arranged in a series. Web W is shown movable upstream to downstream in succession of $W_1$, $W_2$, $W_3$, and $W_4$ as illustrated. Apparatus 1000 is shown on the ground G, although it can be elevated above the ground G if desired. Typically ground G is a concrete floor in a factory.

Figure 11A:
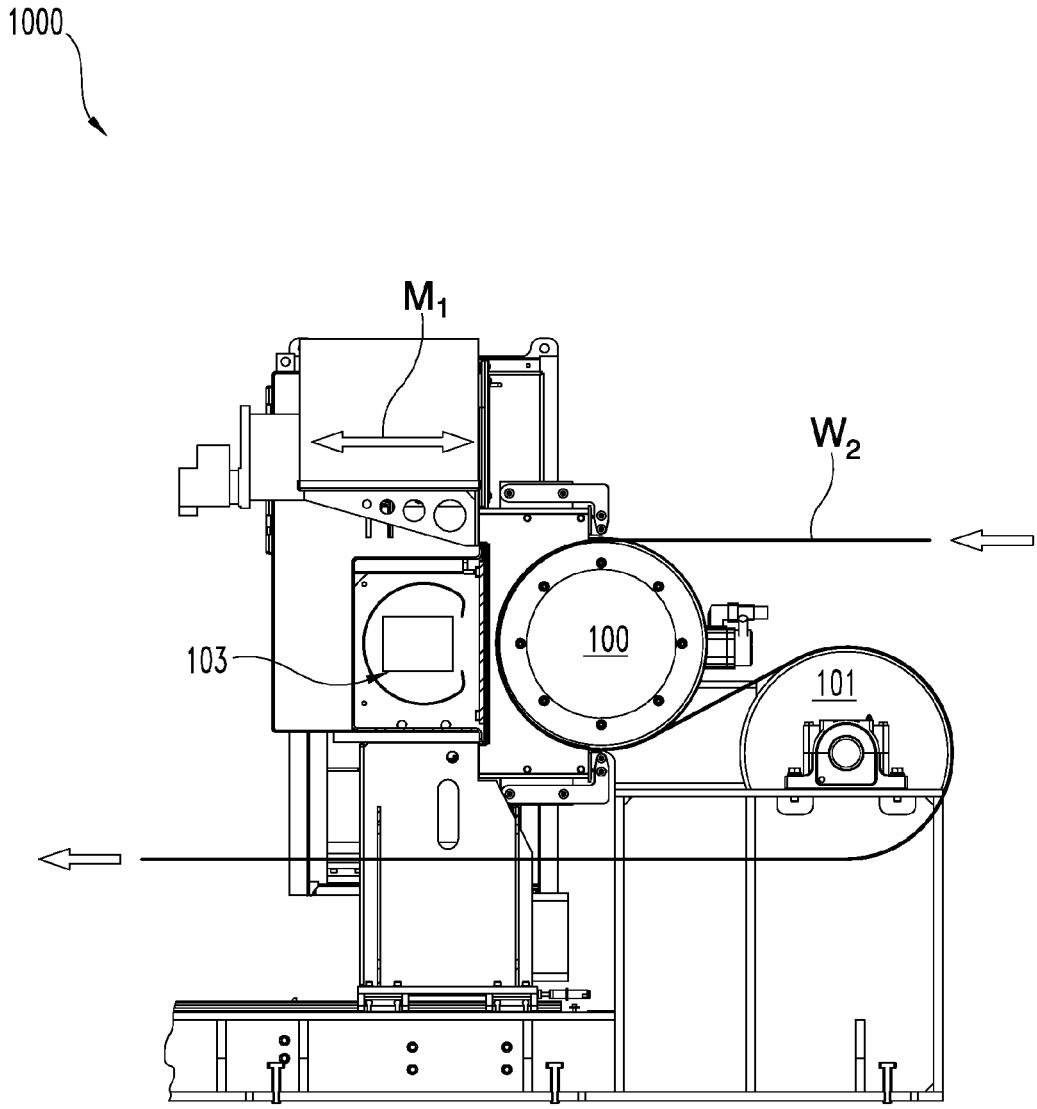
FIG. 11A is a side elevation view of the apparatus showing the diagrammatic path of web W.

Note that optionally, on various points along the path of web W, the web may travel in an upward inclination, vertically, in a downward declination, and/or horizontally. For example, the path at W3 shows the web horizontally, whereas for illustrative purposes the path at $W_2$ shows an inclination of the angle alpha ($\alpha$). In some situations, it is preferable that the path $W_2$ of FIG. 1 is substantially horizontal and/or perfectly horizontal with the alpha of FIG. 1 being a 0 degree inclination. See, for example, W2 of FIG. 11A. Optionally, angle alpha may be less than 30 degrees and greater than −30 degrees.

Figure 2A:
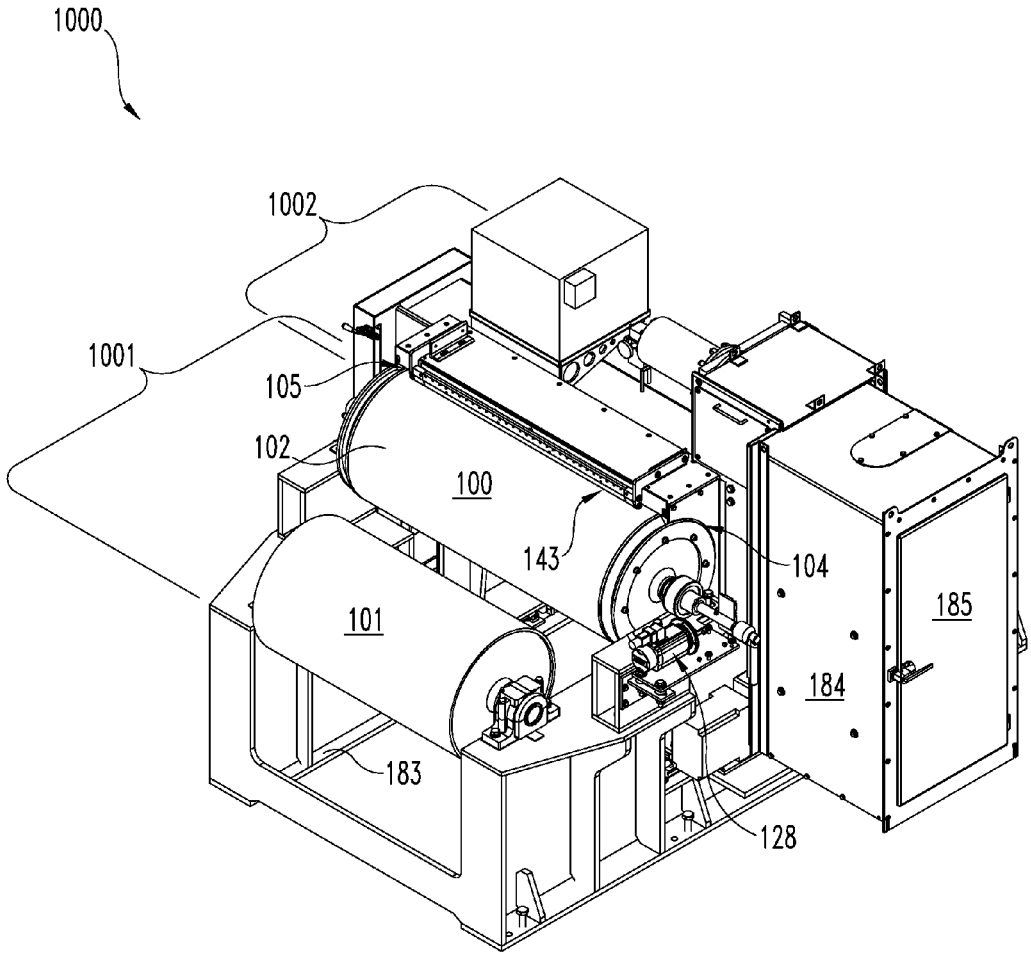
FIG. 2A is a front top perspective view of one example of an ebeam machine 1000 of FIG. 1 in its optional, closed position.
Figure 2B:
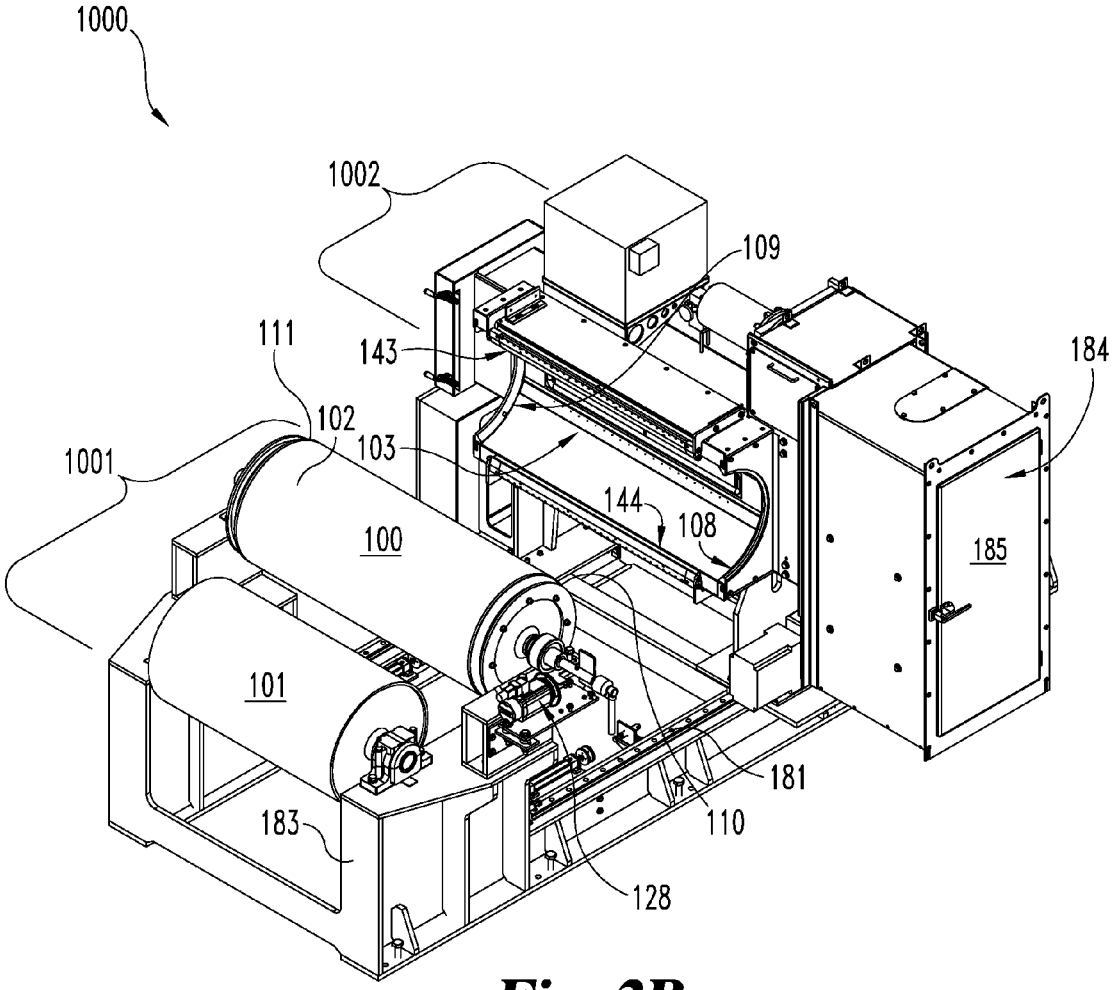
FIG. 2B is a front top perspective view of one example of the present invention in its optional, opened position.
Figure 3A:
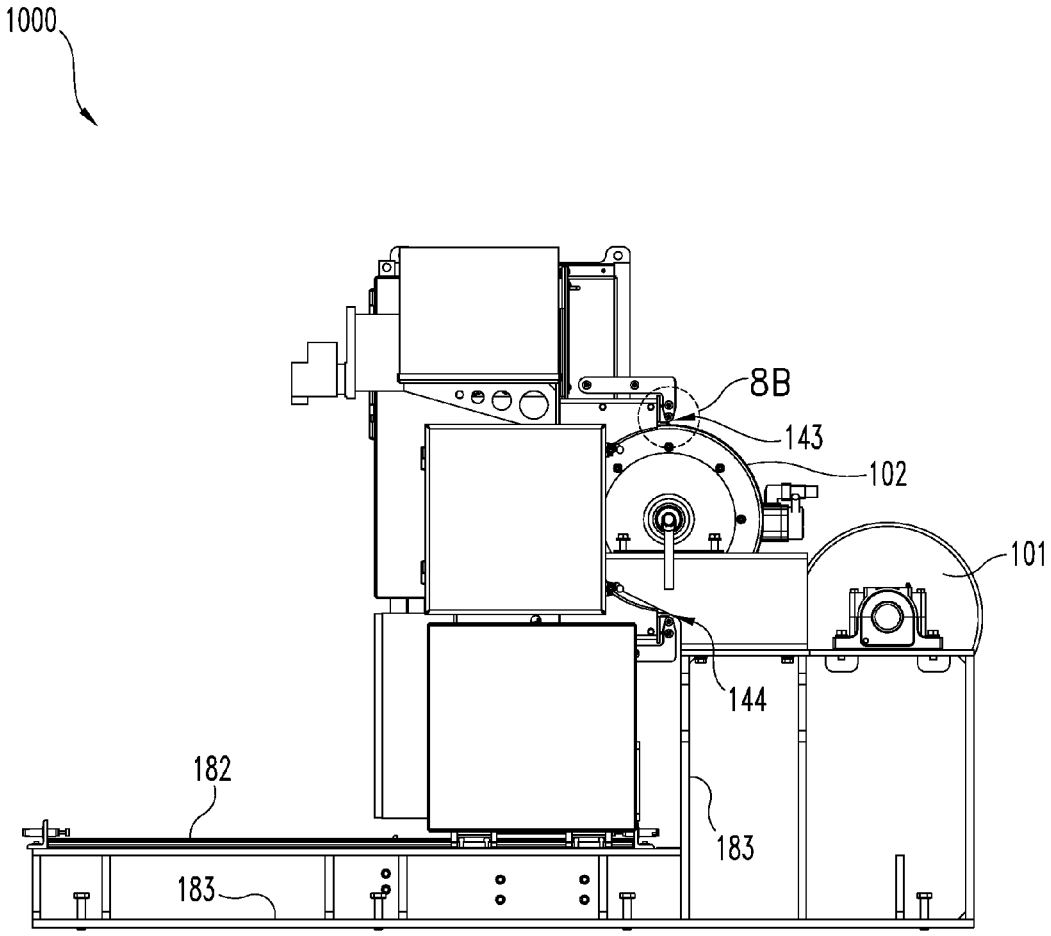
FIG. 3A is a side elevation view of the apparatus of FIG. 2A taken generally along line 3A-3A of FIG. 7.
Figure 3B:
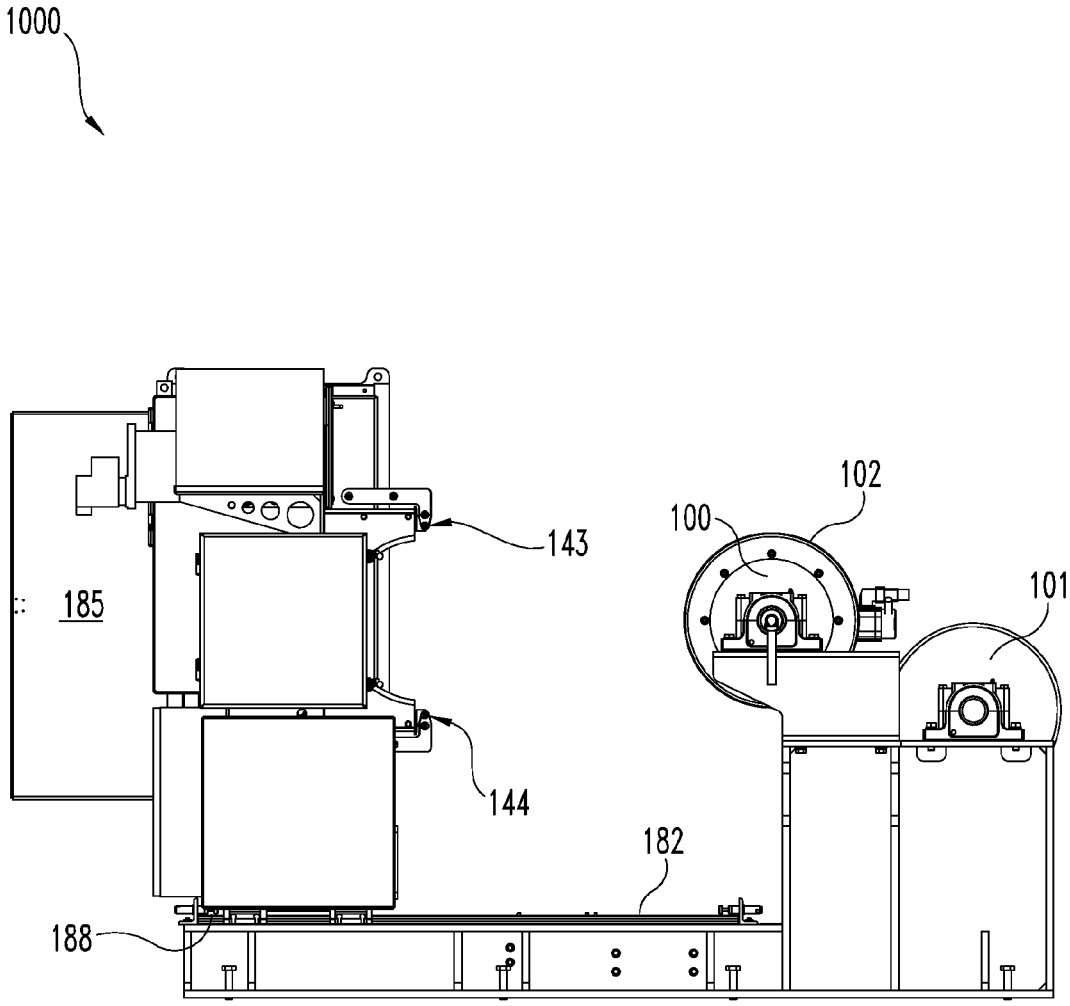
FIG. 3B is the apparatus of FIG. 3A shown in an opened position.
Figure 3C:
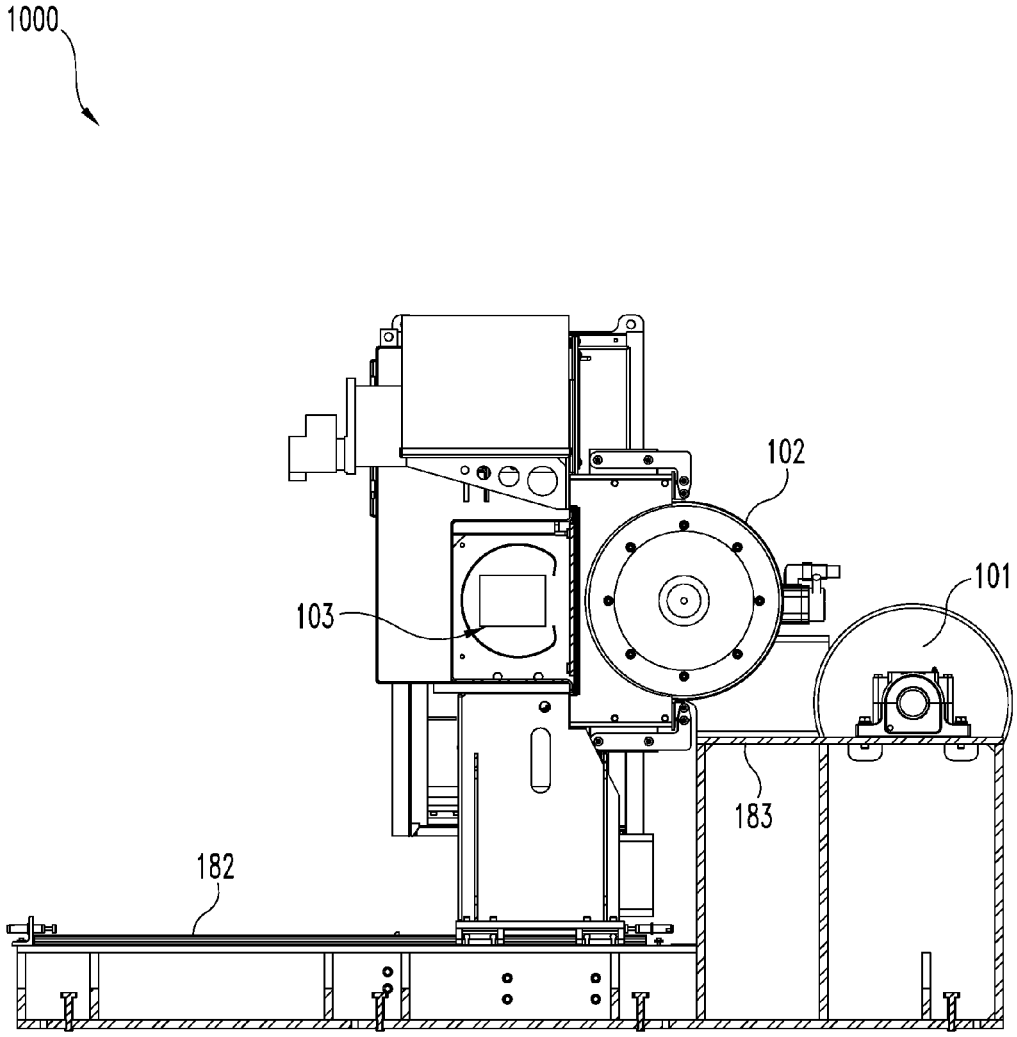
FIG. 3C is a side sectional view of the apparatus of FIG. 2A taken generally along the lines 3C-3C of FIG. 7.
Figure 3D:
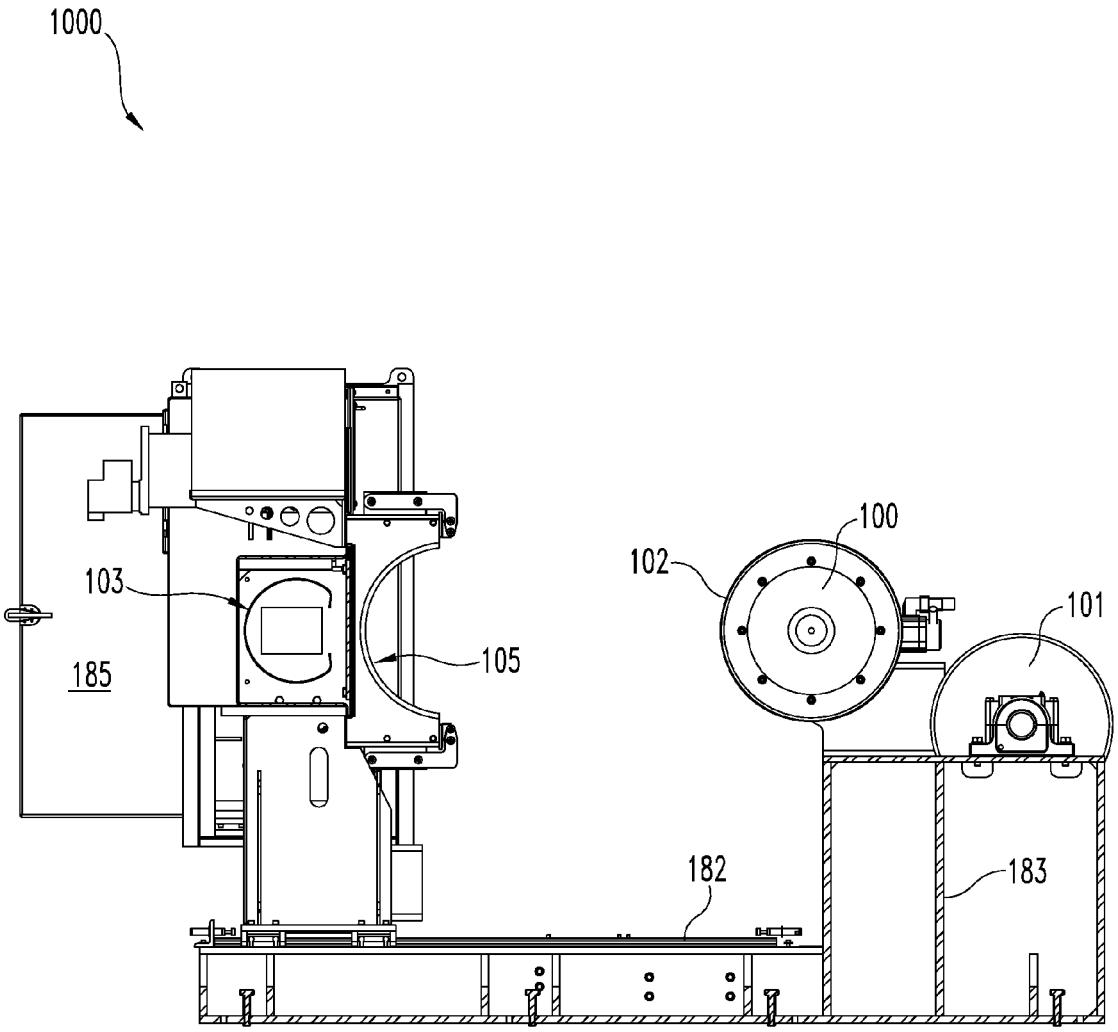
FIG. 3D is the apparatus of FIG. 3C, shown in an opened position.
Figure 3E:
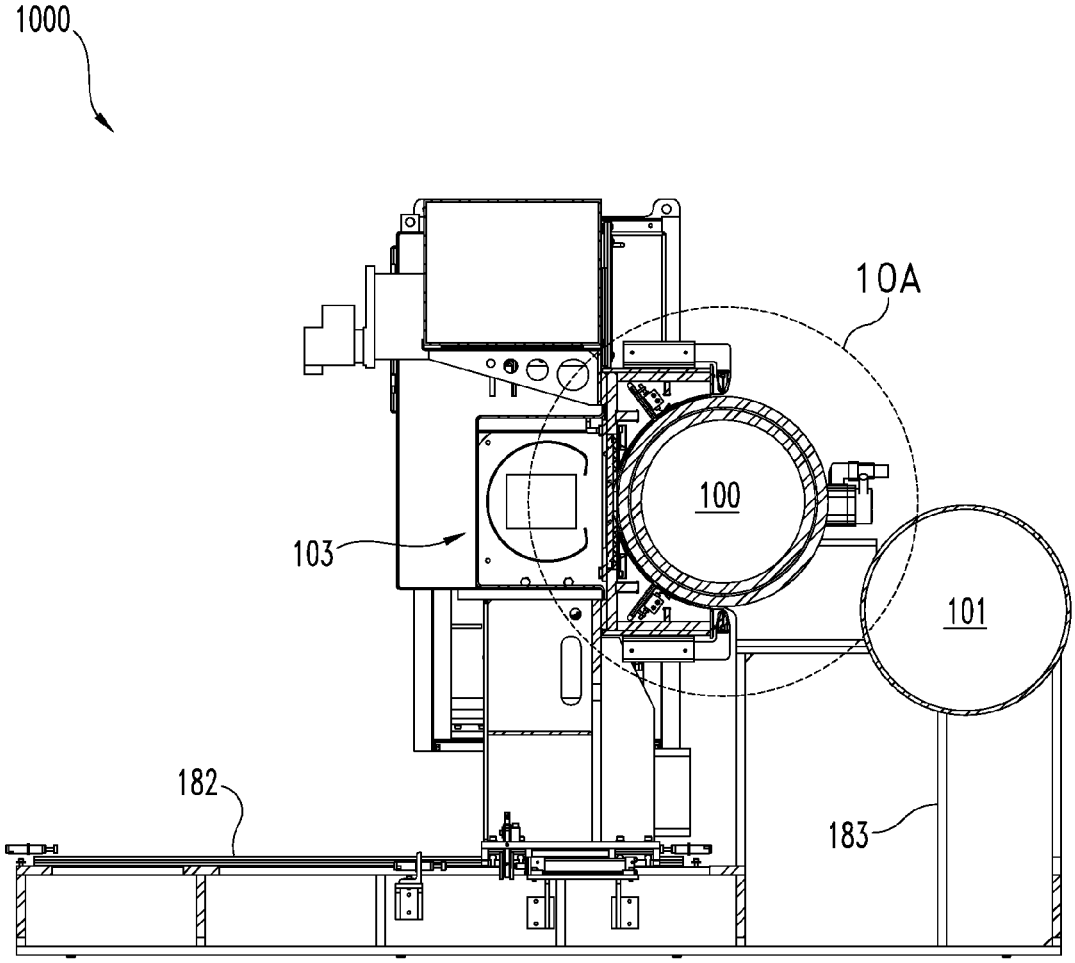
FIG. 3E is a side sectional view of the apparatus of FIG. 2A taken generally along the lines 3E-3E of FIG. 7.
Figure 3F:
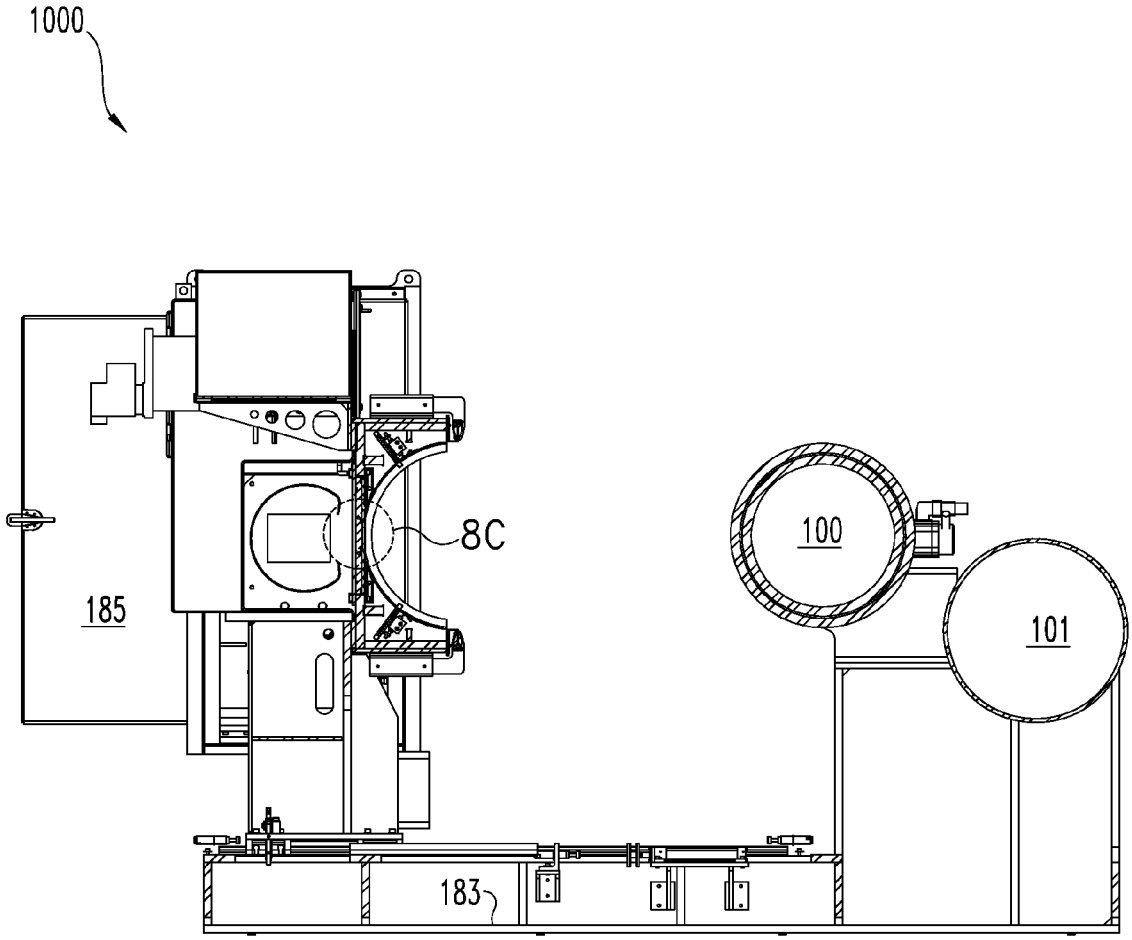
FIG. 3F is the apparatus of FIG. 3E, shown in an opened position.
Figure 4:
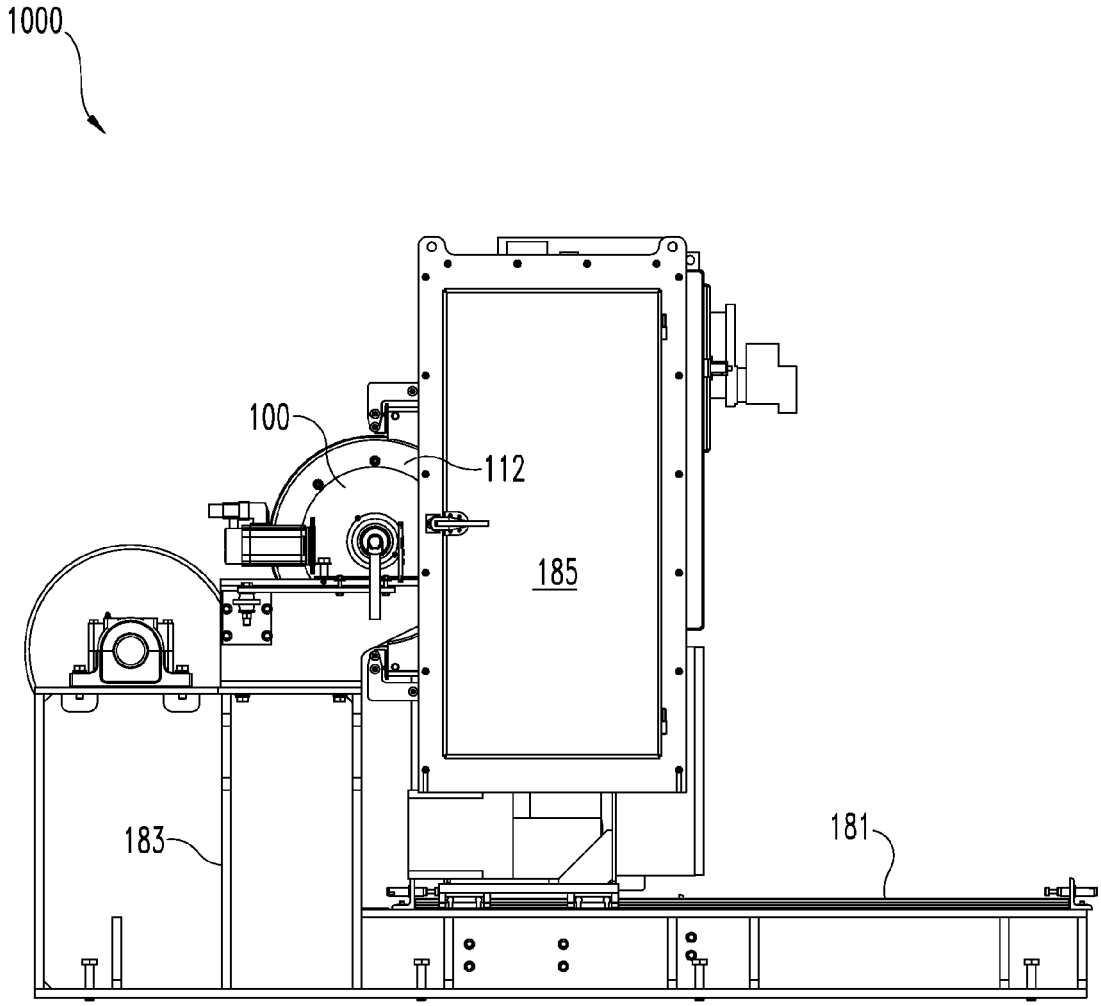
FIG. 4 is a side elevation view of the side opposite of FIG. 3A.
Figure 5A:
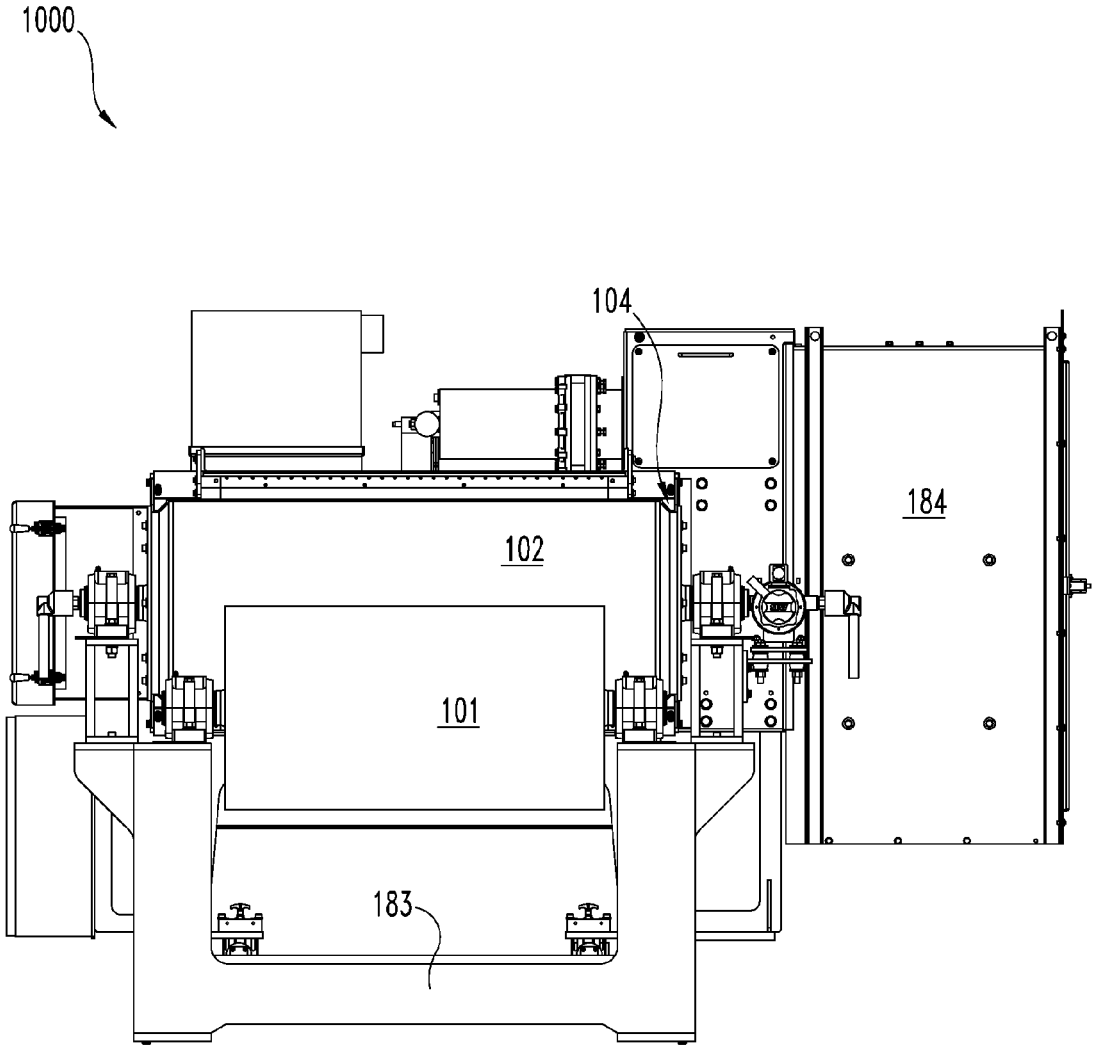
FIG. 5A is a front elevation view of the apparatus of FIG. 2A taken generally along line 5A-5A in FIG. 7.
Figure 5B:
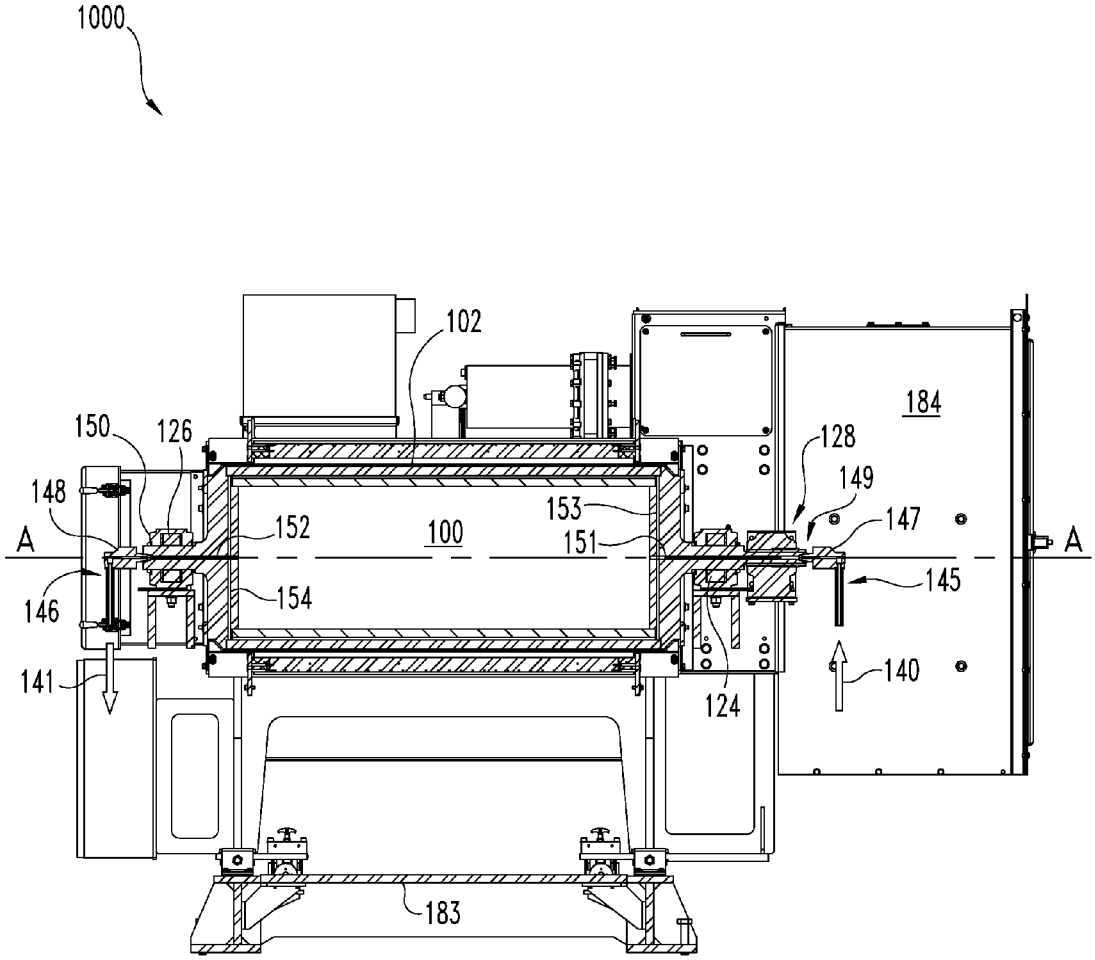
FIG. 5B is a front sectional view of the apparatus of FIG. 2A taken generally along line 5B-5B in FIG. 7.
Figure 5C:
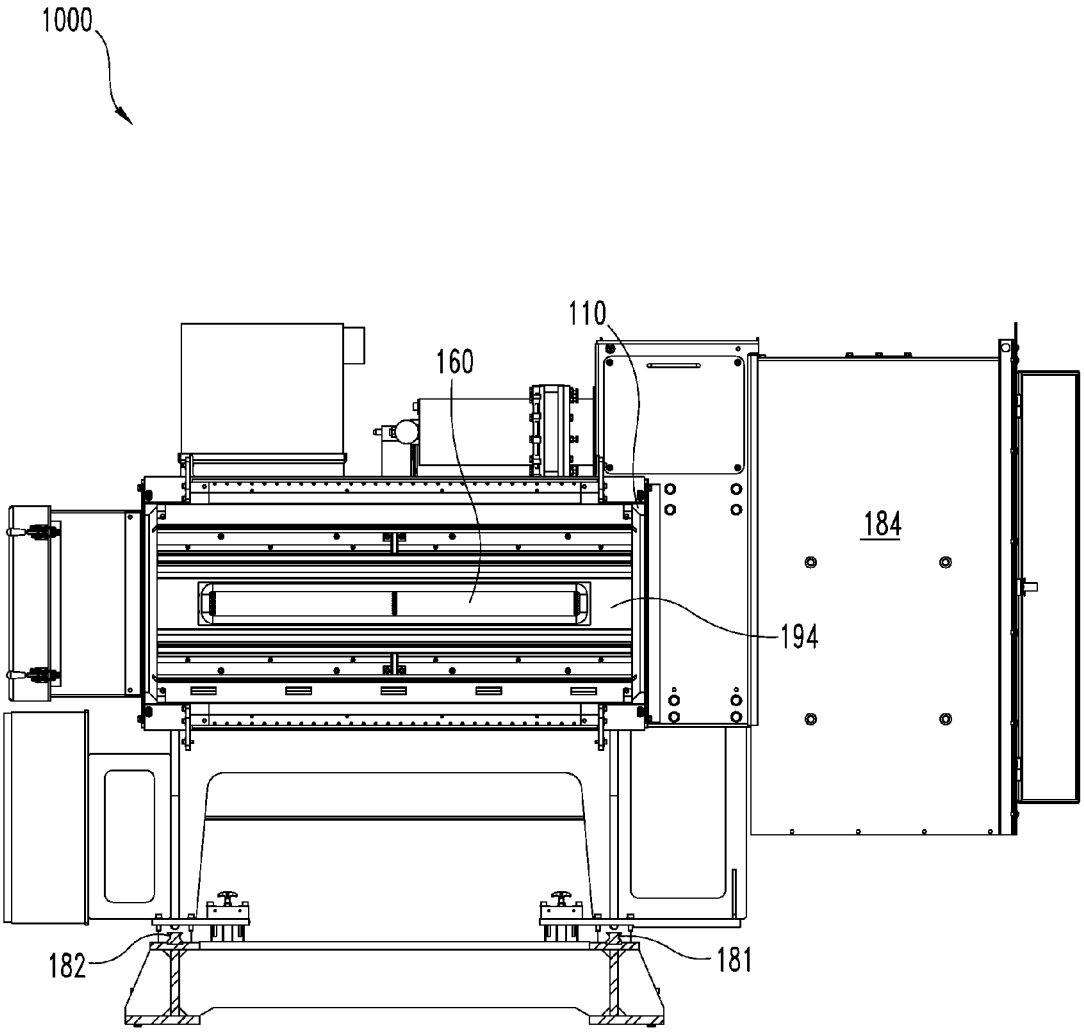
FIG. 5C is a front sectional view of the apparatus of FIG. 2B, in an open position, taken between the roller portion and the electron beam emitter portion.
Figure 6:
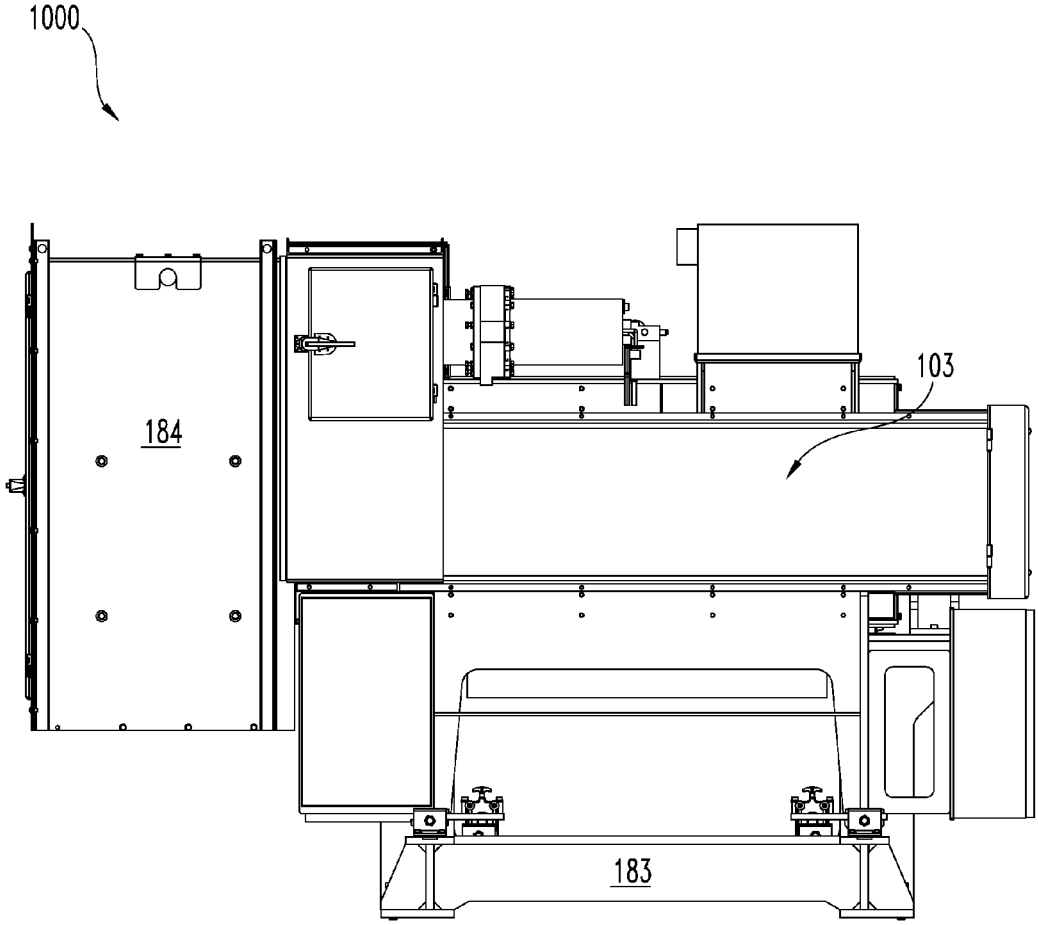
FIG. 6 is a rear elevation view of the apparatus of FIG. 2A.
Figure 7:
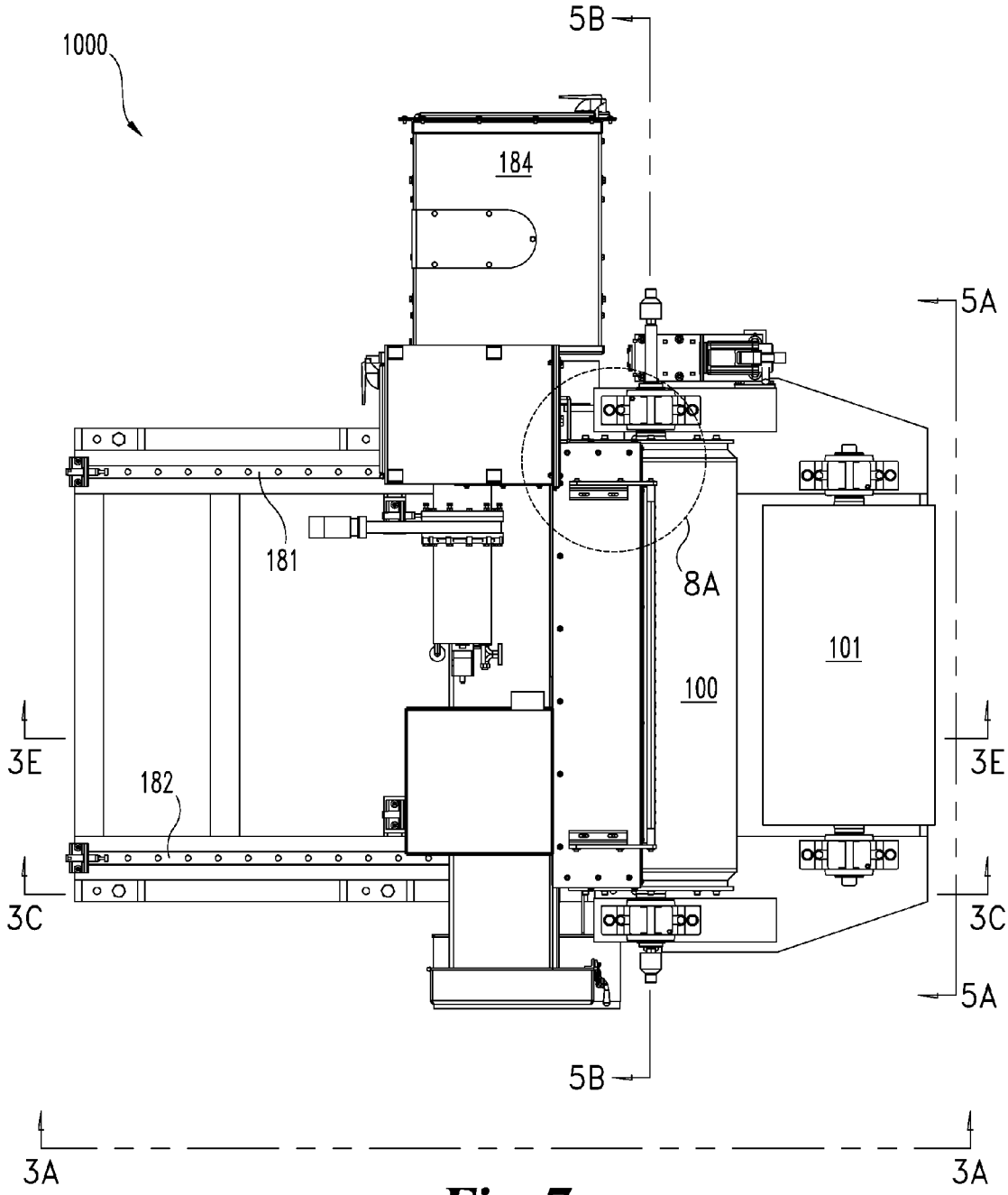
FIG. 7 is a top plan view of the apparatus of FIG. 2A.

Referring to FIGS. 2A-8C, 10A and 10B, one example of apparatus 1000 is illustrated, although modifications and alternatives consistent with the definitions and other portions of this written description or consistent with the literal language of the claims are likewise contemplated. Apparatus 1000 may optionally be a single portion or may have two portions, such as a roller portion 1001 and an electron beam portion 1002. In this optional configuration, as can be seen by comparing the rest of the figures such as FIGS. 2A and 2B, FIG. 2A shows the apparatus in a closed position, whereas FIG. 2B shows the apparatus in an open position. The optional open position feature may provide operator access. For example, such operator access may include, but is not limited to, operator access to the electron beam window, shown in FIG. 5C.

Referring to apparatus 1000, FIG. 2A illustrates a configuration in which the downstream path for the web is from roller 100 to second roller 101 outside of the reaction chamber. In this arrangement, the web wraps partially around the generally cylindrical surface of second roller 101 to double back downstream. (see e.g., FIG. 11A). As further illustrated in FIG. 11A, the web may pass under electron beam emitter 103. Various other roller arrangements can be used depending upon the related upstream apparatus U and downstream apparatus D being used, as is known in the art. Roller 100 may be driven or not driven. A driver, such as driver 128 or otherwise, may be used. An alternative embodiment, the arrangement of the rollers may be reconfigured, such as for example, where the roller 101 higher than roller 100, in which case the web would pass over electron beam emitter 103.

If the optional open/closed feature of apparatus 1000 is used, portion 1001 and 1002 may reside on the same or on separate structures, including but not limited to frame 183. For example, movement may be facilitated by sliding one, or the other, or both portions on tracks such as, for example, tracks 181 and 182. In the illustrated example, portion 1001 containing roller 100 remains comparatively fixed, whereas electron beam portion 1002 may be moved on tracks. In addition to one or more tracks, such as tracks 181 and 182, other mechanisms can be utilized optionally, to facilitate moving the electron beam portion and/or the roller portion between the open and closed positions. For example, in addition to a straight track, the track may be curvilinear, preferably in the arc of a circle. Another arrangement would be a pivoting arrangement, such as about a horizontal axis or about a vertical axis or pivot. In such way, one portion could pivot away from and towards the other portion between the open and closed positions. Another arrangement would be to have one or more, and preferably at least two, interfaces which can couple or lock together. For example, the roller portion could be on a stationary frame or otherwise. The electron beam portion could be supported on casters or other forms of wheels that could be wheeled away from the roller portion, but that the interface mechanism would help align the two portions in the closed mode, and preferably provide locking of the two together in the closed position. For example, locking could be done with mechanical threading members, latches (cam or otherwise), snap-fit, shear pins, or otherwise. Note that with all of these possibilities, the opposite portion may be fixed and/or movable. For example, the portion containing the electron beam generator may be relatively fixed, with the roller portion moveable therewith. In the embodiment illustrated in FIGS. 2A and 2B, merely one of these examples is shown with the roller portion relatively fixed, and the electron beam portion movable to the open position. However, as mentioned, these can be inverted. One optional feature is that by having the roller portion fixed the apparatus can be opened for cleaning or for replacing the electron beam window while maintaining the web tensioned on the roller, without cutting or loosening the web.

Other features can include a power cabinet 184, door 185, as illustrated, although not required. Another optional feature is one or more switches, such as interlock switches. While not shown in the drawing figure, one or more switches may be placed, for example, along or near track 181 or 182, or to be switched by part of a frame, when an apparatus is moved from a closed position to an opened position or vice versa. If the optional feature of the switch is used, most preferably, but not necessarily, the switch may be used to prevent operation of the electron beam generator when the apparatus is not in a closed position.

A reaction chamber may be provided adjacent electron beam emitter 103 and having radiation shielding for substantially containing or de-energizing radiation produced from the electron beams. The reaction chamber may have any one of a multitude of sizes, shapes, and volumes. One example depicted here can be seen in FIG. 10B as reaction chamber C, defined in whole or in part by radiation shielding X.

A roller, such as roller 100, incorporates shielding X that serves as a boundary for the reaction chamber C, such that the shielding allows one part of the roller that has a web in contact with it to be irradiated by the electron beam, while another part of the roller's surface is outside of the reaction chamber C. The shielding could include an added layer at or in close proximity to the circumferential surface of radiation shielding material. Roller 100 as illustrated has radiation shielding in the form of thick steel, namely the two concentric shells, sufficient for at least low energy applications. Other shielding may be used as well. Optionally, for example, other shielding could take the form of spoke arrayed walls radiating from the central axis of the roller to the circumference of the circumferential surface of the roller.

Another option feature is having a single roller, such as roller 100, be the only roller in, and/or the only roller partially defining, the reaction chamber. This optional feature may further be employed with (or without) other rollers, such as roller 101, fully outside of the reaction chamber.

Figure 8A:
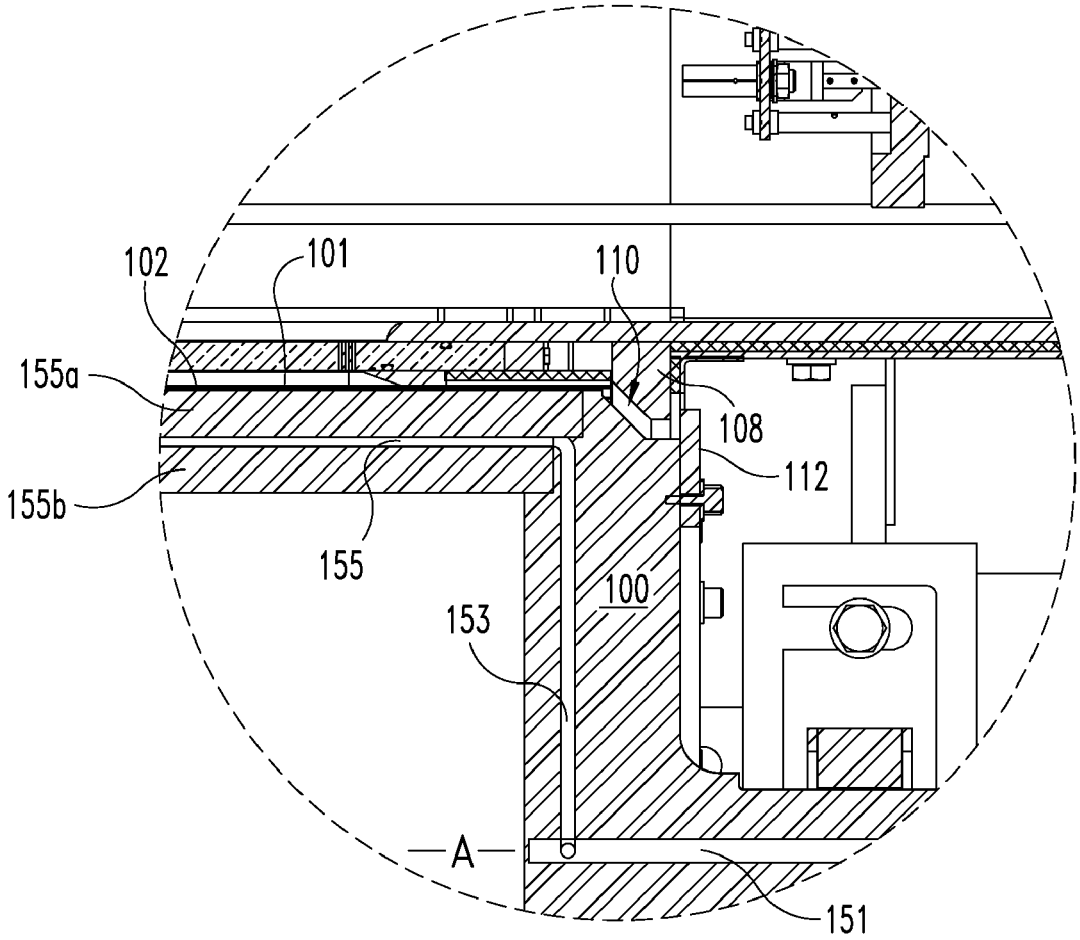
FIG. 8A is a partial sectional view of the apparatus of FIG. 2A taken generally at the location of detail 8A in FIG. 7, showing circumferential radiation shielding with tongue 108 interfacing with groove 110.
Figure 8B:
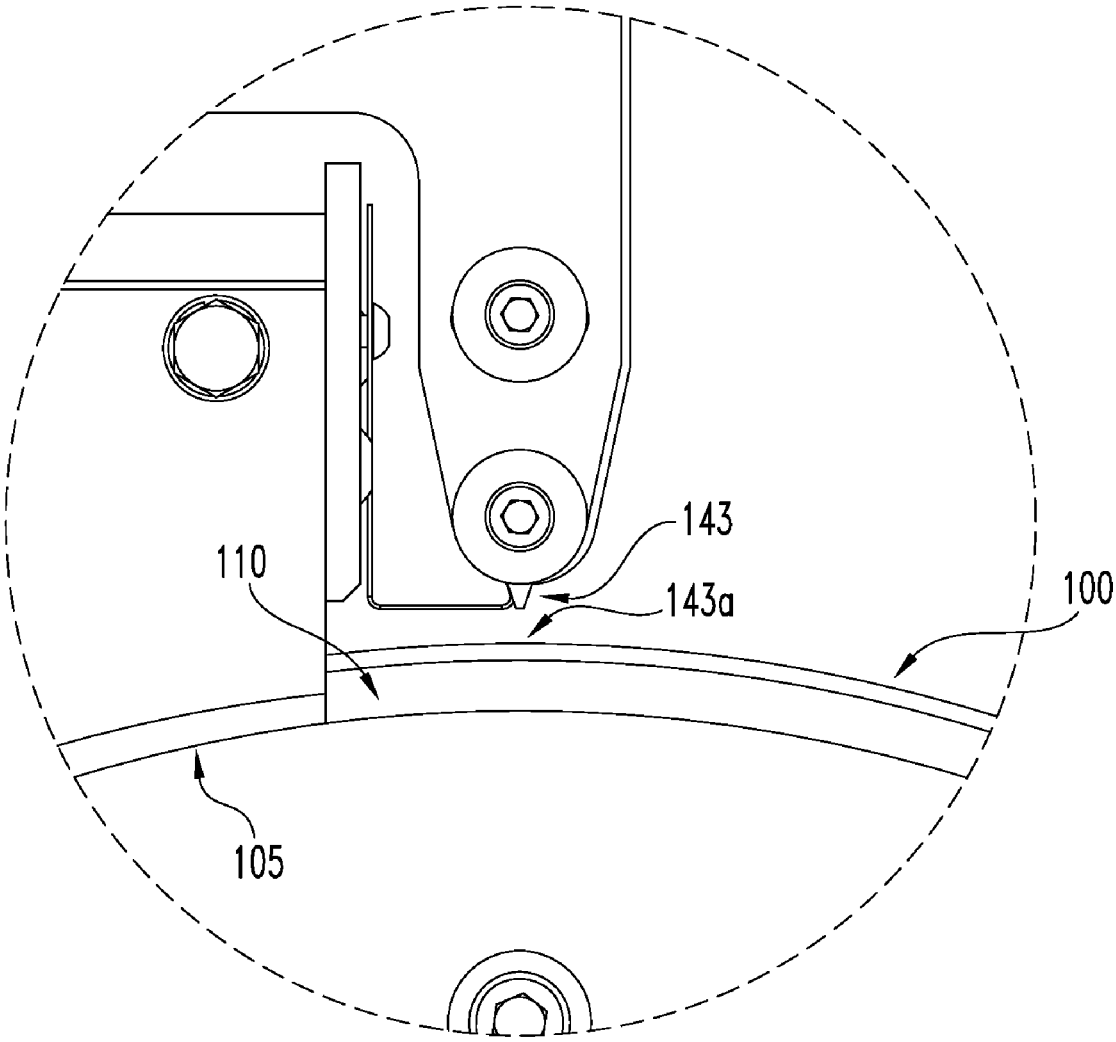
FIG. 8B is a detailed view showing detail 8B in FIG. 3A.
Figure 8C:
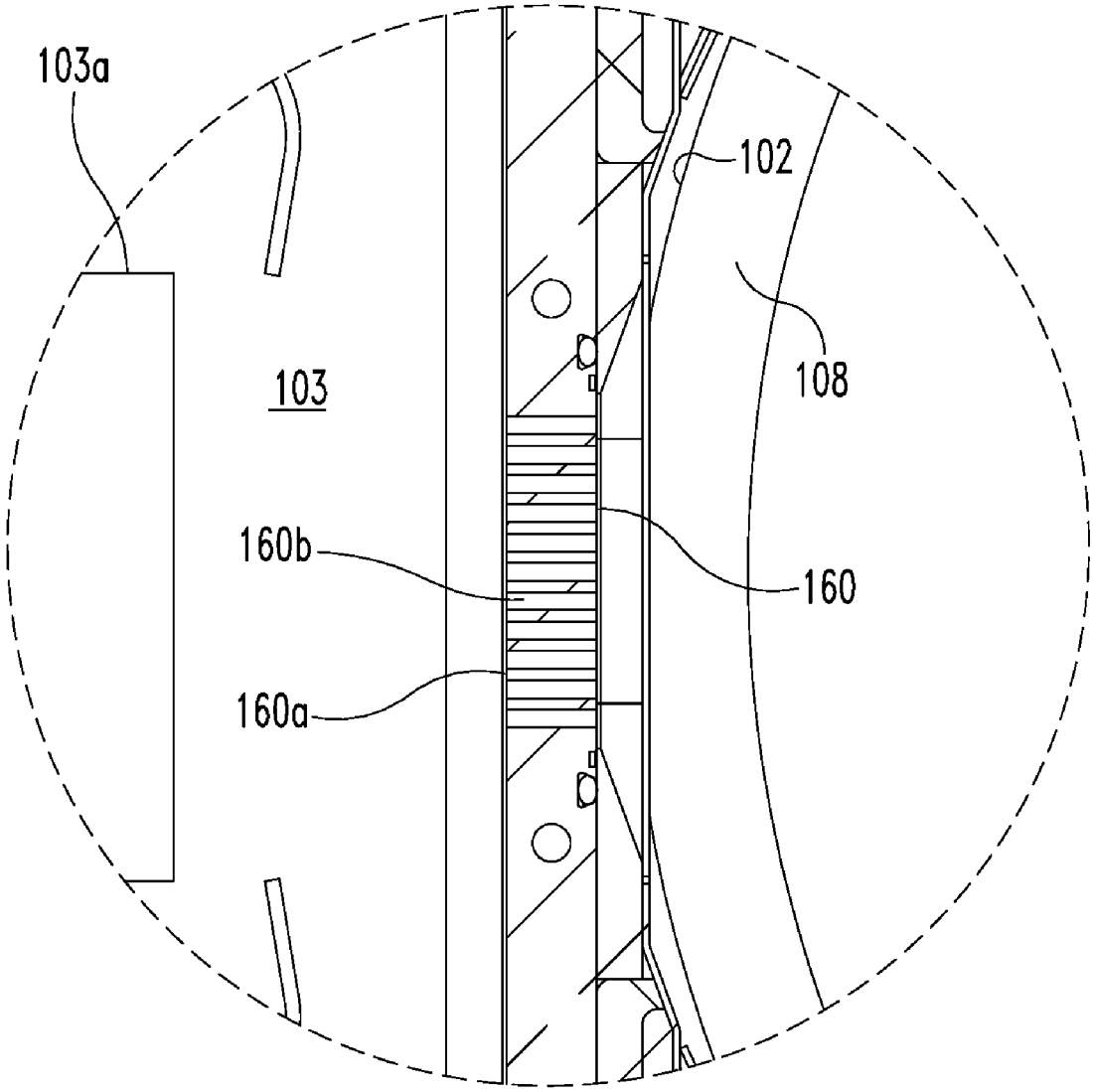
FIG. 8C is a detailed view showing detail 8C in FIG. 3F.

Another optional feature of the present invention is circumferential radiation shielding. This may take a wide variety of structural and functional forms. As an example, circumferential radiation shielding may comprise a tongue and groove interface. One specific example of circumferential radiation shielding is shown as circumferential radiation shielding 104 and 105 shown in FIG. 2A. Circumferential radiation shielding 104 and 105 may be formed by tongues 108 and 109 (see e.g., FIG. 2B) that mate with corresponding grooves 110 and 111 on roller 100. A closer view of this is illustrated in FIG. 8A. In that example, circumferential radiation shielding may be provided by tongue 104 interfacing with groove 110. This interface occurs around at least a portion of the circumference of roller 100 in an arc of circumference. Additionally, groove 100 may be defined, or enhanced, at least in part, by a variety of structures, one example of which is shown as end-plate 112 in FIG. 8A. Additionally, a groove may be fully machined into a single piece of material, or formed by the assembly of additional sub-components. Note that groove 110 is partially defined on the other side by a tapered, sloping surface forming a thrusting conical chamfer on the axial end of roller 100. Again, this is merely one example and other geometries, locations and structures may be used. Other non-limiting examples of circumferential shielding are illustrated FIGS. 9A-9G.

Figure 9A:
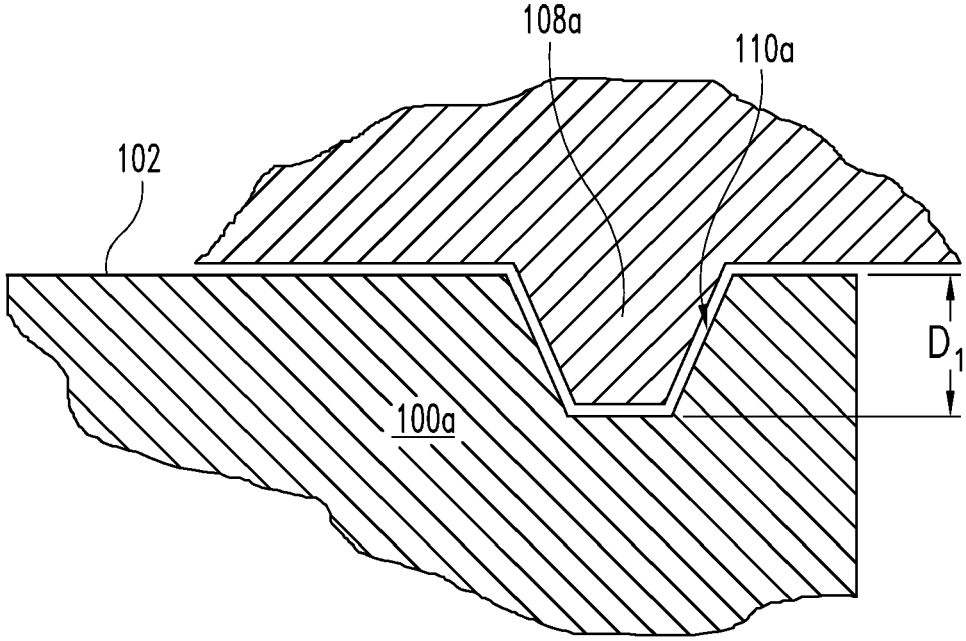
FIG. 9A is an alternative example to the circumferential radiation shielding shown in FIG. 8A.

FIG. 9A illustrates roller 100A with a cylindrical surface 102. Tongue 108*a* is shown interfacing with groove 110*a*. As illustrated in FIG. 9A, the groove (as well as the tongue) have one or more sides sloping and tapering in an axial direction. Note that groove 110*a* has a deepest point as shown by depth $D_1$.

Figure 9B:
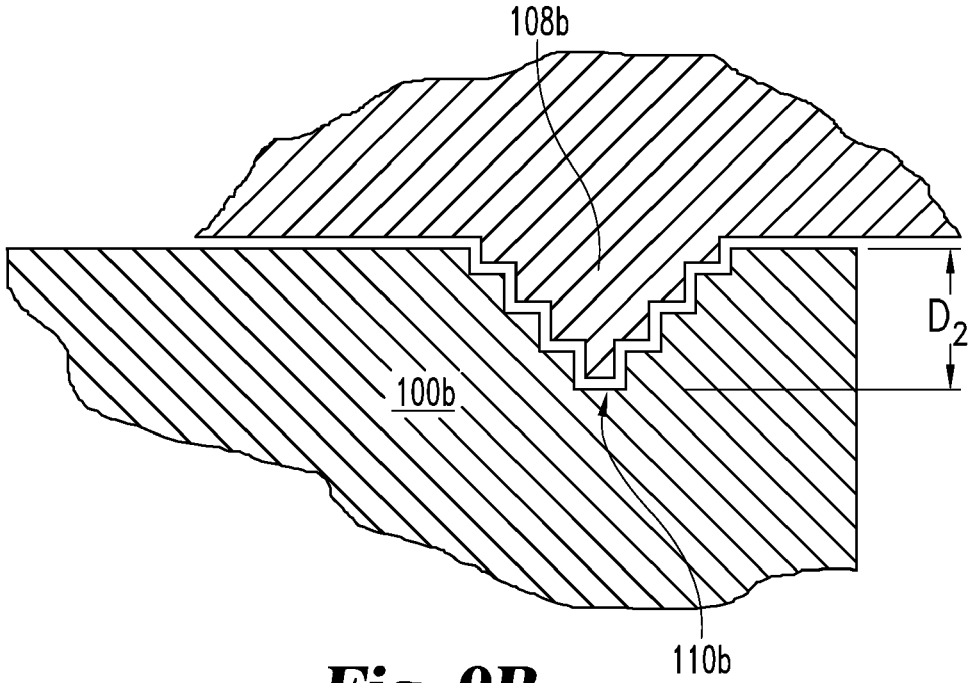
FIG. 9B is an alternative example to the circumferential radiation shielding shown in FIG. 8A.

FIG. 9B illustrates roller 100*b*. Tongue 108*b* is shown interfacing with groove 110*b*. As illustrated in FIG. 9B, the groove (as well as the tongue) have one or more sides tapering in an axial direction. Note that groove 110*b* has a deepest point as shown by depth $D_2$.

Figure 9C:
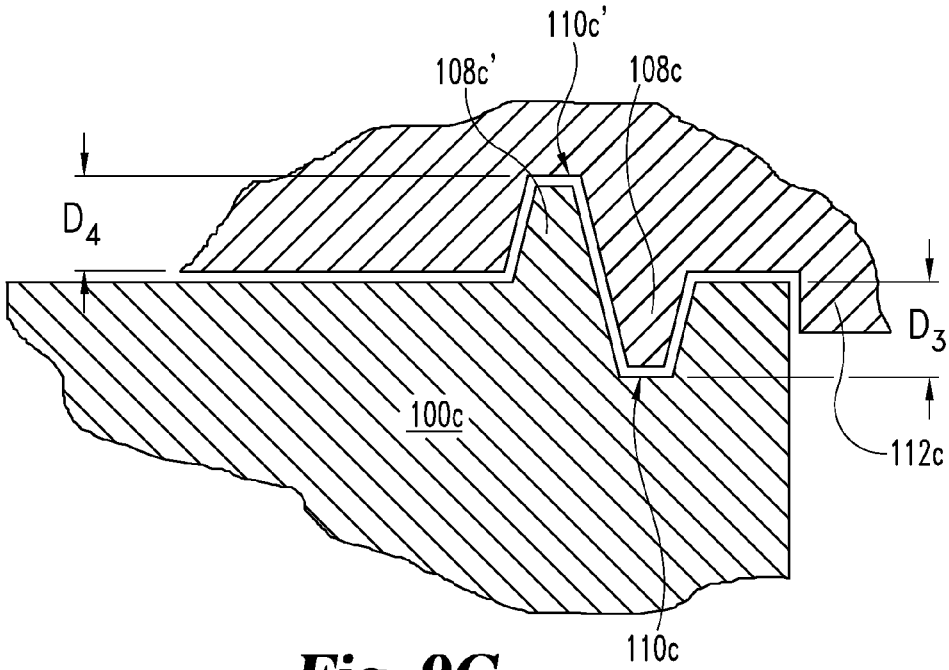
FIG. 9C is an alternative example to the circumferential radiation shielding shown in FIG. 8A.

FIG. 9C illustrates roller 100*c*. Tongue 108*c* is shown interfacing with groove 110*c*. Tongue 108*c*' is shown interfacing with groove 110*c*'. As illustrated in FIG. 9C, the grooves (as well as the tongues) have one or more sides sloping and tapering in an axial direction. Note that grooves have their deepest points as shown, respectively by depths $D_3$ and $D_4$.

Figure 9D:
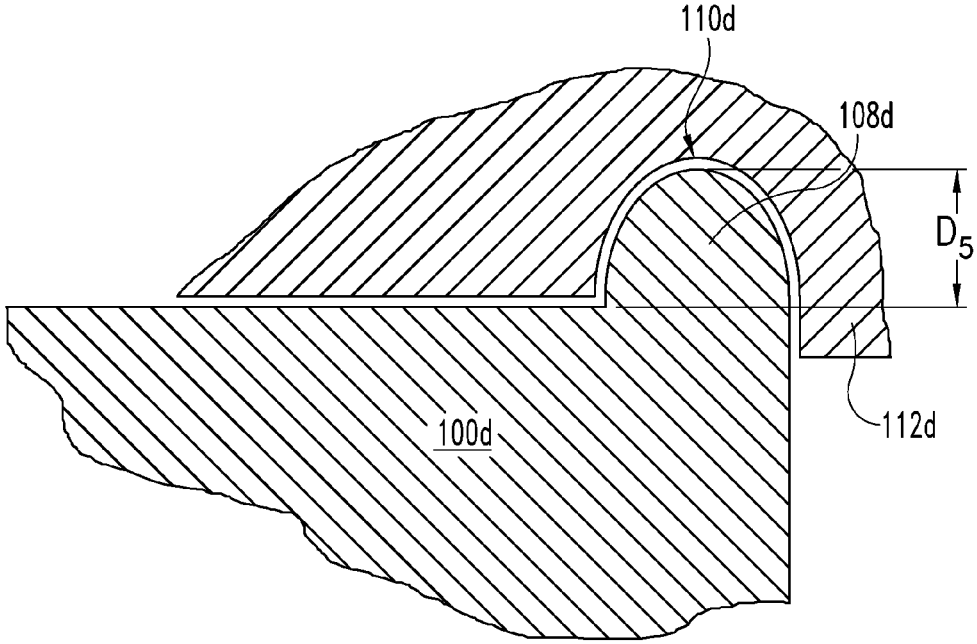
FIG. 9D is an alternative example to the circumferential radiation shielding shown in FIG. 8A.

FIG. 9D illustrates roller 100*d*. Tongue 108*d* is shown interfacing with groove 110*d*. As illustrated in FIG. 9D, the groove (as well as the tongue) have one or more sides sloping and tapering in an axial direction, and have part of their surfaces curved. Note that groove 110*d* has a deepest point as shown by depth $D_5$. Note also that end cover 112*d* may extend around part of the edge and end of roller 100*d*, providing a longer and more tortured path axially for radiation.

Figure 9E:
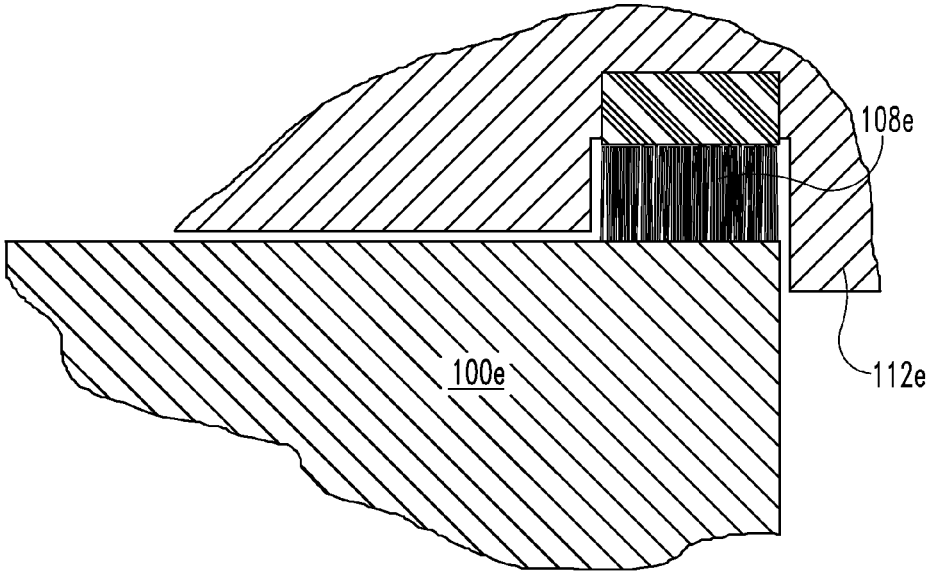
FIG. 9E is an alternative example to the circumferential radiation shielding shown in FIG. 8A.
Figure 9F:
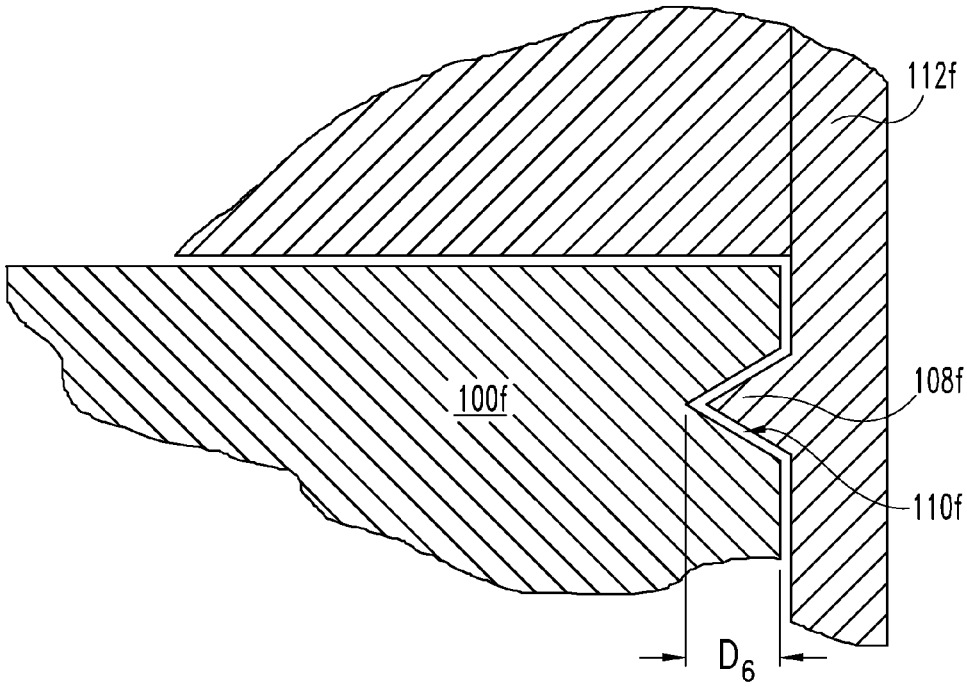
FIG. 9F is an alternative example to the circumferential radiation shielding shown in FIG. 8A.

FIG. 9E illustrates roller 100*e*. Instead of or in addition to any tongue and/or groove, brush 108*e* is present. The brush is preferably in contact with the roller while allowing the roller to rotate. Preferably, the brush has some flexibility, and is made of and/or includes radiation shielding. Such shielding may be in the form of bristles (e.g. radiation shielding, particulate-containing polymer bristles) or foam or elastomer (e.g. radiation-shielding, particulate-containing polymer foam or elastomer), or otherwise, and may have a sufficiently tortured path therebetween for substantially containing or de-energizing radiation. Note also that end cover 112*e* may extend around part of the edge and end of roller 100*e*, providing a longer and more tortured path axially for radiation. While not as preferred, a brush with bristles, foam or elastomer or the like can not only directly contact the regular surface of a roller 100, but with other options not specifically illustrated, can be shaped as a tongue to fit in a groove of the type shown in the other examples set forth for use with a solid tongue. FIG. 9F illustrates roller 100*f*. Tongue 108*f* is shown interfacing with groove 110*f*. As illustrated in FIG. 9F, the groove (as well as the tongue) have one or more sides sloping and tapering in an axial direction. Note that groove 110*f* has a deepest point as shown by depth $D_6$. Note also that end cover 112*f* may extend around part of the edge and end of roller 100*f*, providing a longer and more tortured path axially for radiation. Moreover, cover 112*f* may be made, optionally, movable in an axial direction (to the right in FIG. 9F) to allow separation of the roller and emitter for electron beam window replacement.

Figure 9G:
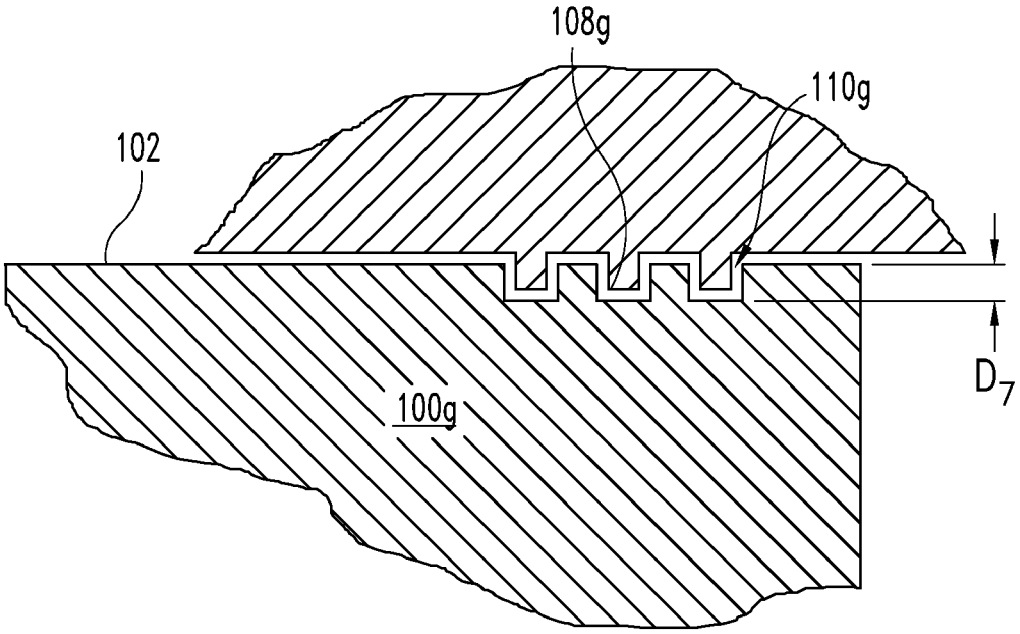
FIG. 9G is an alternative example to the circumferential radiation shielding shown in FIG. 8A.

FIG. 9G illustrates roller 100*g* with a cylindrical surface 102. A series of tongues, such as tongue 108*g* are shown interfacing with grooves, such as grove 110*g*. As illustrated in FIG. 9G, the groove (as well as the tongue) do not have one or more sides sloping nor tapering in an axial direction. Note that groove 110*g* has a deepest point as shown by depth $D_7$. In FIG. 9G, the use of more grooves that are each shallower and not tapered, provides an alternative to a single tongue and groove that has tapering in the axial direction.

Any of the forgoing may be modified, mixed, matched, and combined for circumferential radiation shielding. Preferably, some or all of the interfaces are in close proximity. This will help contain or de-energize radiation, including radiation moving generally in an axial direction with respect to the roller as well as those moving approximately tangentially to the circumference. A non-tapered sided groove with a comparatively larger deepest point provides more travel distance for the radiation and the potential for a less tortured path out of the reaction chamber, particularly those radiation tangent to the roller at a point, such as the deepest point, in a non-tapered groove. As such, the optional feature having a tapered or sloped arrangement of the groove, tongue and/or gap therebetween is a preferred alternative, in three dimensions.

Additionally, having a series of two or more tongue and groove and/or brush and/or other structures (see, for example, FIGS. 9C, 9E, 9G and/or a combination of other figures) allow for a design with a comparatively shallower deepest point of a groove, while nevertheless providing shielding in an axial direction. As can be seen, each of the examples of FIG. 8A as well as FIGS. 9A-9D and FIGS. 9F illustrate grooves having the deepest point of the groove laterally offset from its shallowest point.

While the illustrated examples depict the circumferential radiation shielding as part of the electron beam portion 1002 of the apparatus, optionally, such circumferential radiation shielding may be part of the roller portion 1001, or both. For example, the arc of a circumference or circumference radiation shielding may be part of the roller portion, and relatively fixed with respect to the roller. Such circumferential radiation shielding may be: (1) around all (or some) of the roller circumference and/or an arc thereof, and, (2) separately interface, contact, engage or otherwise cooperates with radiation shielding at a separate joint or interface with radiation shielding that surrounds the reaction chamber and/or the electron beam emitter. This optionally may facilitate having the circumferential shielding greater than 180 degrees around the circumference of the roller (although it may be less than 180 degrees) including having the circumferential radiation shielding all the way (360 degrees) around the circumference of the roller. Thus, as an optional example, with the foregoing arrangement if the apparatus has the open-closed feature, it may be optionally in the open position in which the split or joint or separation in the radiation shielding between the electron beam portion and the roller portion is not necessarily along the circumference of the roller, but rather is elsewhere.

One optional feature is that roller 100 may be supported for rotation at least by one bearing, such as for example, bearing 124, bearing 126 (see e.g. FIG. 5B), or both, or along with other supports or bearings. Optionally, one or both bearings supporting the roller may be outboard of respective circumferential radiation shielding, such as shielding 104 and 105. Typically, such bearings are used to support an axle or axle structure as illustrated along axis A-A (see FIG. 5B) and having a diameter substantially less that the diameter defined by the cylindrical surface 102 where it contacts the web.

Similarly, when a driver is used, such as driver 128, it may engage roller 100 outside of the reaction chamber. See FIG. 2A. Alternatively, a driver may engage the roller inside of the reaction chamber, in whole or in part. For example, one arrangement may be to have a separate drive roller with a separate drive web that wraps around the drive roller and wraps around roller 100 and acts as a driver of roller 100 with the drive web passing in and out of the reaction chamber, and with web W on the outside of such drive web.

Another optional feature is having the roller 100 of apparatus 1000 be the only roller for contacting the web that is within the reaction chamber. Another optional feature is that a depositor of uncured material (see for example, depositor U in FIG. 1) deposits material on an upper side of the web upstream from the roller, such as for example illustrated in FIG. 1 and FIG. 11A. In such an optional arrangement, the web follows a path from the depositor to the roller 100 that is free of contact with other rollers contacting the uncured material on the second side of the web (top side as shown in these Figs.). Alternative arrangements could be made where the web comes in from the bottom of roller 100, in which the case the deposited material would be on that bottom surface, as it is usually preferable to have the deposited material closest to the ebeam and not in contact with the roller 100 when it is being irradiated.

Another optional feature is that one or more of the rollers, such as roller 100, be chilled by coolant fluid flowing into and/or out of the roller. This may be done in a wide variety of ways, including, without limitation, through one or more conduits passing through the entire roller, near the cylindrical surface of the roller, both or otherwise. One example is illustrated with particular reference to FIGS. 5B and 8A. A fluid inlet 147 may receive a supply of fluid from conduit 145 in the flow direction 140. The coolant inlet may include a stationary conduit 147 which is, in the example illustrated, located at the axis A-A of roller 100. Optionally, a seal, such as seal 149 may be provided that allows rotation between the roller and stationary conduit 147 while maintaining the substantially fluid tight seal there between. Fluid may flow through the roller in a variety of ways. In the example shown, conduit 151 is connected to one or more radial conduits, such as conduit 153. Fluid flows therefrom to one or more conduits in thermal communication with surface 102 of the roller. Such conduit may be axial conduit 155 (see FIG. 8A) which, in this one particular example, is a cylindrical shape gap formed between cylinder 155*a* and 155*b* (see FIG. 8A). Fluid flows from conduit 155 to other radial conduit such as 154 and then into conduit 152. The fluid may then flow into stationary conduit 148, preferably passing through a seal, which may be similar to seal 149 on the inlet side. Stationary conduit 149 may be part of the fluid outlet, such as, for example, through conduit 146 in the outlet direction 141. Optionally, the fluid direction may be reversed from 140 and 141. Moreover, other arrangements may be configured where the fluid flow inlet and outlet are on the same side as each other. The fluid flow and cylinder need not be limited to axial flow, but may be also helical flow, radial flow, and/or a combination thereof. Note that optionally, the fluid seal, such as seal 149, is located outside the reaction chamber. Further, optionally, it may be located axially outboard of bearings, such as bearing 128. A further option for enhancing fluid flow and heat exchange within the roller 100 is to have helical ribs (not shown) on either the outside of cylinder 155*b* or the inside of cylinder 155*a* that may affect the flow of fluid as the roller 100 rotates.

Another optional feature is the use of inert gas and/or inert gas dispensers in connection with the roller 100, the web and/or the reaction chamber. Inert gas dispensers may be included inside the reaction chamber, outside the reaction chamber, or both.

One optional feature is to have at least one, and possibly two or more, inert gas dispensers such as dispensers 143 and 144 (see FIGS. 2A, 2B, 3A, 3B and 8B, for example). In that type of arrangement, inert gas is dispensed, preferably at various locations and/or all along the axial length of roller 100. In the particular example, these inert gas dispensers are located outside the reaction chamber, and are near the entrance point 143*a* and the exit point 144*a* by the reaction chamber. Other inert gas dispensers, not shown, connect to the interior of the reaction chamber near the window, and can add a cooling effect to the window. These help maintain the interior of the reaction chamber as being filled with inert gas, and similarly for the entrance and exit areas, for example, so as to minimize the generation of ozone, as well at to minimize reactions with ambient elements (such as oxygen), and/or as well as to possibly provide additional cooling for the web.

Another optional feature which may be present alone and/or in conjunction with one or more inert gas dispensers is the use of gas barriers. Gas barriers may take on many different shapes and geometries. These may include barriers having correspondingly curved surfaces in close proximity with cylindrical surface 102 of roller 100. Inert gas may be dispensed near the moving web surface, such as by dispenser 143 near the web, and/or dispensed otherwise to reach areas adjacent to the web where it is being irradiated with the electron beam. As one example, referring to FIG. 10A the apparatus may have one or more gas barriers 191, 192, 193 and/or 194. In the preferred embodiment, these are made of thin material, such as sheet metal or otherwise, that is close to and corresponds with the curved surface of the roller. Hence, when gas is dispensed from dispenser 143, barriers 191-194 maintain the gas near the web as it travels (counterclockwise in FIG. 10A) through the reaction chamber. Optionally, gas can be used to help with cooling the web and/or the roller 100.

Such gas barriers may include radiation shielding, may lack radiation shielding, or both. In the case where such gas barriers are radiation shielded, these may serve the dual function of being a gas barrier as well as being baffles for radiation shielding purposes.

Figure 10A:
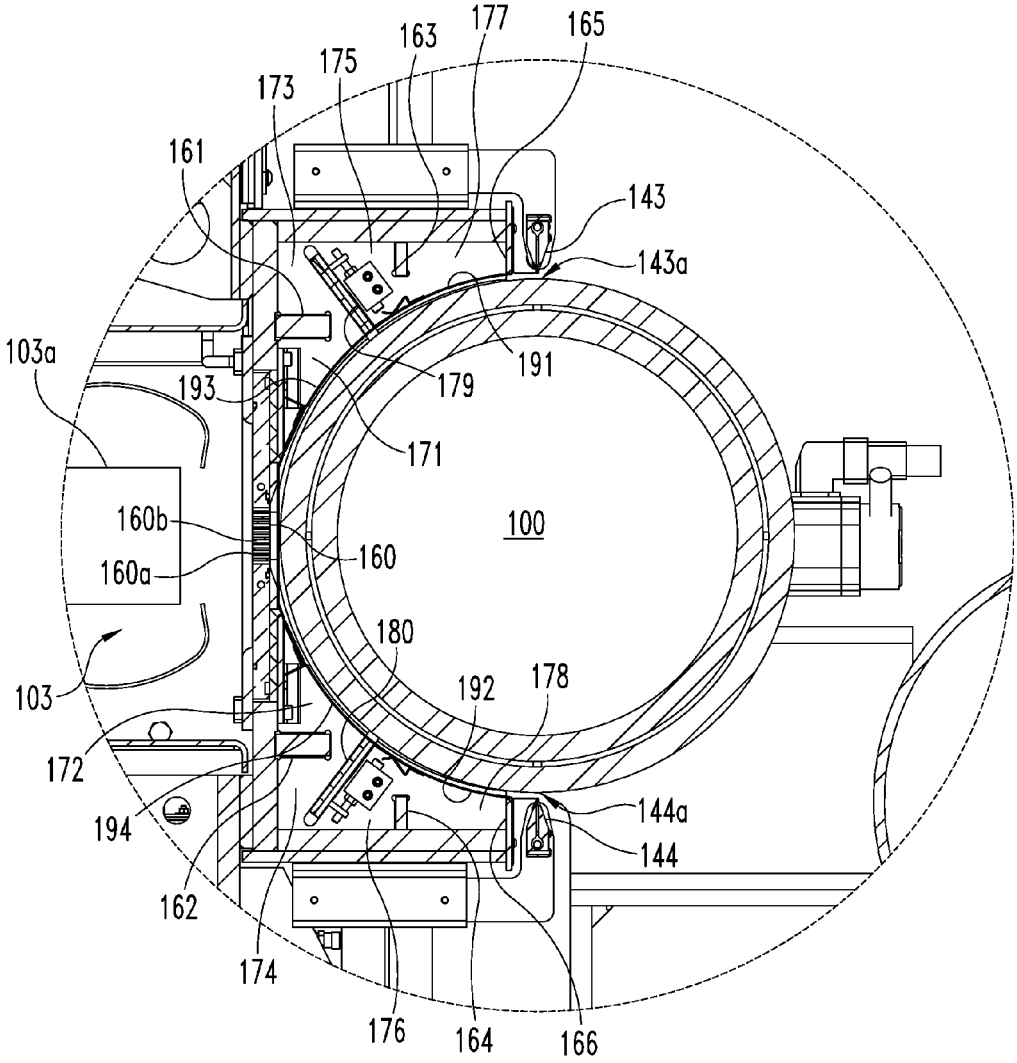
FIG. 10A is a detail view taken from detail 10A of FIG. 3E.
Figure 10B:
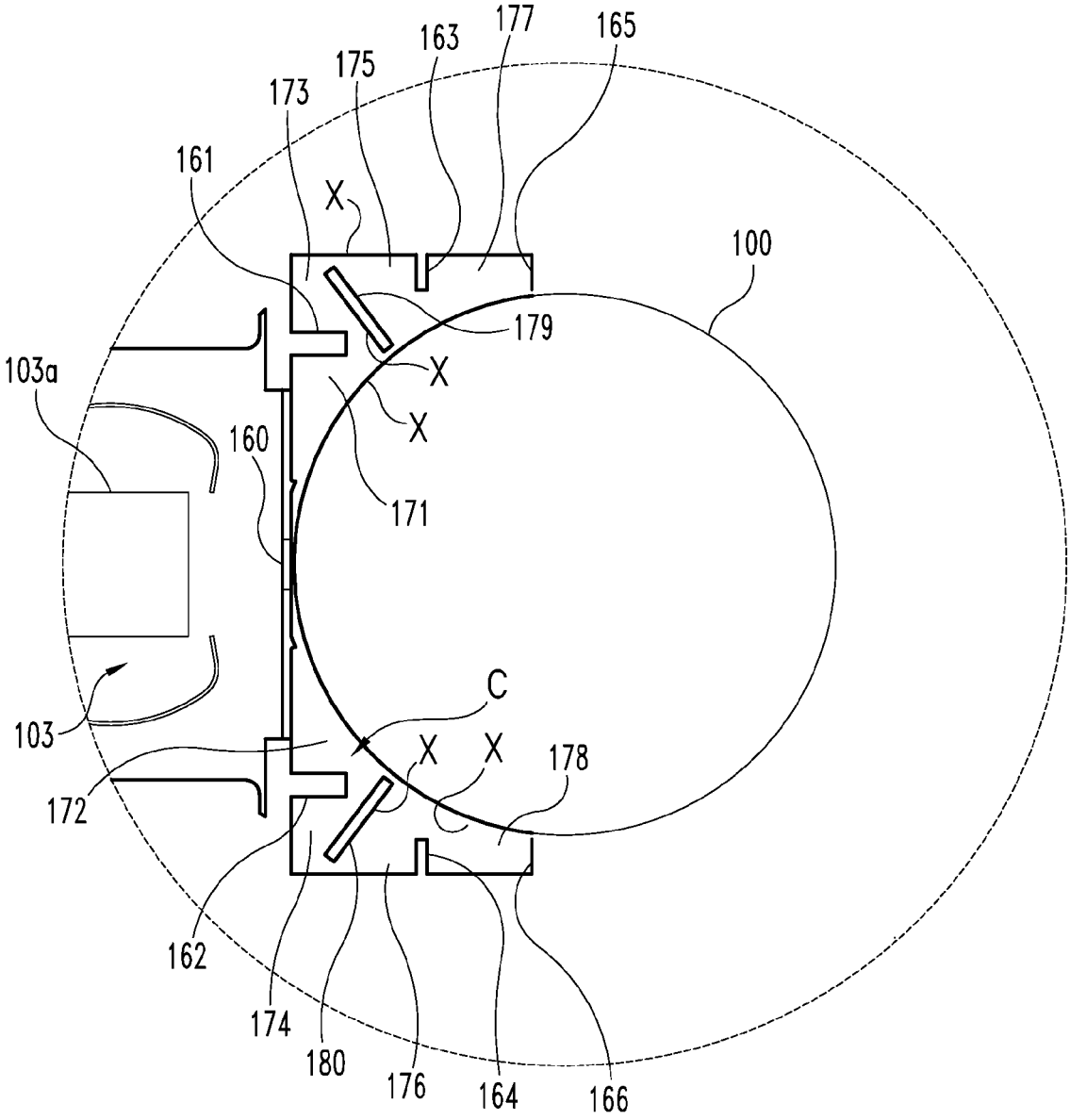
FIG. 10B is a simplified version of FIG. 10A, showing an example of a reaction chamber.

Another optional feature is the use of one or more baffles in the reaction chamber. These baffles may help contain or de-energize radiation produced from the radiation beams. As but one example, with reference to FIGS. 10A and 10B, the reaction chamber may include baffles 161, 162, 163, 164, 165, 166, 179 and/or 180, or with others. In the reaction chamber, the baffles may segment the inside of the reaction chamber into successive voids. Examples of these are depicted in FIG. 10A, and diagrammatically in FIG. 10B, as voids 172, 173, 174, 175, 176, 177, and 178.

In terms of baffles, one optional feature is to have one or more baffles, such as baffle 179 and/or 180, be adjustable. As illustrated in FIG. 10A, there are threaded mechanisms or other adjustment slides that can be used. In this configuration, those baffles 179 and/or 180 may be adjusted to be close to, and preferably in close proximity to, the outside surface of the web on roller 100 in the reaction chamber. Although in some circumstances they can be made to contact the web, preferably they are very close to, but free of contact with the web. Thus, for example, baffles 179 and 180 extend to a point near the surface of roller 100 that leaves space for the web to pass, but limited area for radiation energy to pass from one void, such as 174 to the next, such as void 176. Additionally, this succession of voids previously described provide for radiation to successfully contact more surfaces to successively reduce the radiation energy with each contact.

Preferably, the foregoing is accomplished with a comparatively small reaction chamber C in terms of volume. It may be noted that in FIG. 10B, the reaction chamber C is depicted diagrammatically with the bolder lines illustrating one example of radiation shielding X, including the previously discussed optional features of radiation shielding on various other side walls, baffles and/or roller. Having a smaller reaction chamber can reduce the cost of shielding materials and reduce the size of the overall machine, and its overall cost.

The electron beam window provides a barrier for the vacuum within the electron beam emitter 103, and is positioned relatively close to the web as it passes by on the rotating drum. An example of a window is illustrated in FIG. 10A, including foil 160 supported by a cooled grid 160*a* with apertures 160*b* through that grid for the passage of electron beams. The window, or windows, may be substantially parallel to some baffles such as baffles 163 and/or 164. The window may be substantially perpendicular to other baffles, such as baffles 161 and/or 162, and may be angled (non-orthogonal) with respect to others, such as baffles 179 and/or 180.

Moreover, in the configuration illustrated, one configuration of the electron beam emitter 103 vis a vis roller 100 is that the plane of the window is substantially vertical. This arrangement provides for a side fire configuration of the electron beam emitter. Alternatively, the apparatus may be configured with other orientations, such as a down fire arrangement with the window horizontally placed vertically above roller 100. Additionally, more than one electron beam emitter and/or window may be utilized in connection with one or more rollers, such as roller 100.

Figure 11B:
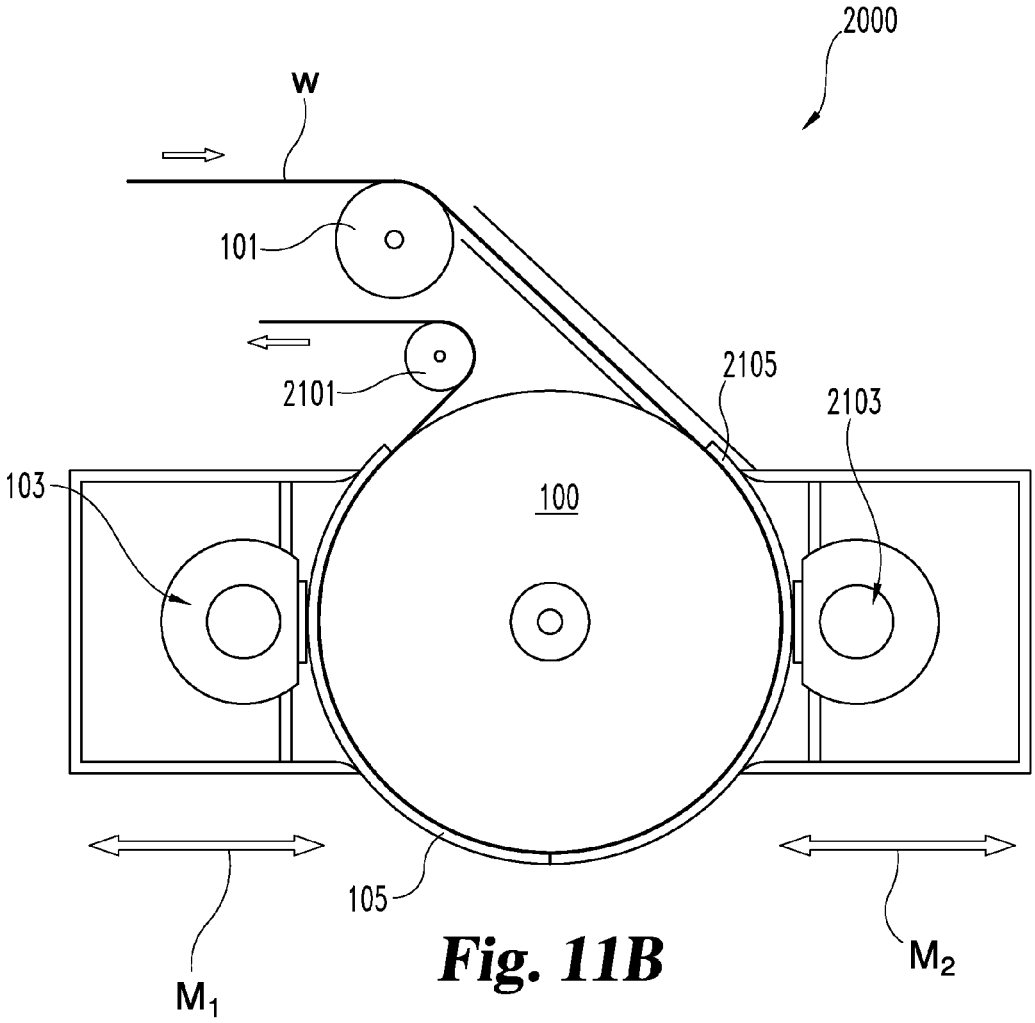
FIG. 11B is an alternative example showing multiple electron beam emitters portions.

For example, an alternative arrangement is illustrated in FIG. 11B. This example shows apparatus 2000 with web W passing in contact with the roller 101. The web wraps partially around roller 100 and may be exposed to electron beam emitter 2103 and 103. Optionally, in addition to the two beam emitters illustrated, 103 (downstream) and 2103 (upstream), a third, fourth and other electron beam emitters may be arrayed around one or more rollers, such as roller 100. Moreover, roller 100 may be augmented with one or more additional rollers within a reaction chamber, or in separate reaction chambers adjacent, with additional electron beam emitters associated with them. Note further that movement $M_1$ and/or movement $M_2$ may optionally be provided to allow one or more of the beam emitters to be moved between an open and closed position to allow operator access to the respective beam emitters. The emitter portion with emitter 103 may include circumferential radiation shielding 105 (as previously discussed), and emitter 2103 may have circumferential radiation shielding 2105. Note further that various arrangements, including that illustrated in FIG. 11B, with the location of part of the surface of rollers 101 and 2101 being completely outside the reaction chamber, nonetheless the second surface of the web (top surface depicted in FIG. 11B) is nonetheless free of contact with other rollers from the time it leaves the upstream depositor until after it is irradiated with electron beams while passing around roller 100. While the use of two successive electron beams that are simultaneously operating gives advantages in some situations, their sequential operation can be an option where only one is needed at a time. One electron beam emitter can continue in operation while maintenance or service on the other can be done without interrupting production. Moreover, a sensor that senses failure of an upstream unit can automatically begin operation of a standby downstream unit to eliminate any interruption of production when an unplanned fault of the upstream electron beam emitter occurs.

Having two or more successive electron beams also affords flexibility as it may be preferable for some web irradiation to use two or more electron beams, while at other times energy can be saved and irradiation optimized by using only one. The apparatus of FIG. 11B may have one or more of the other optional features previously discussed and/or defined above.

Figure 11C:
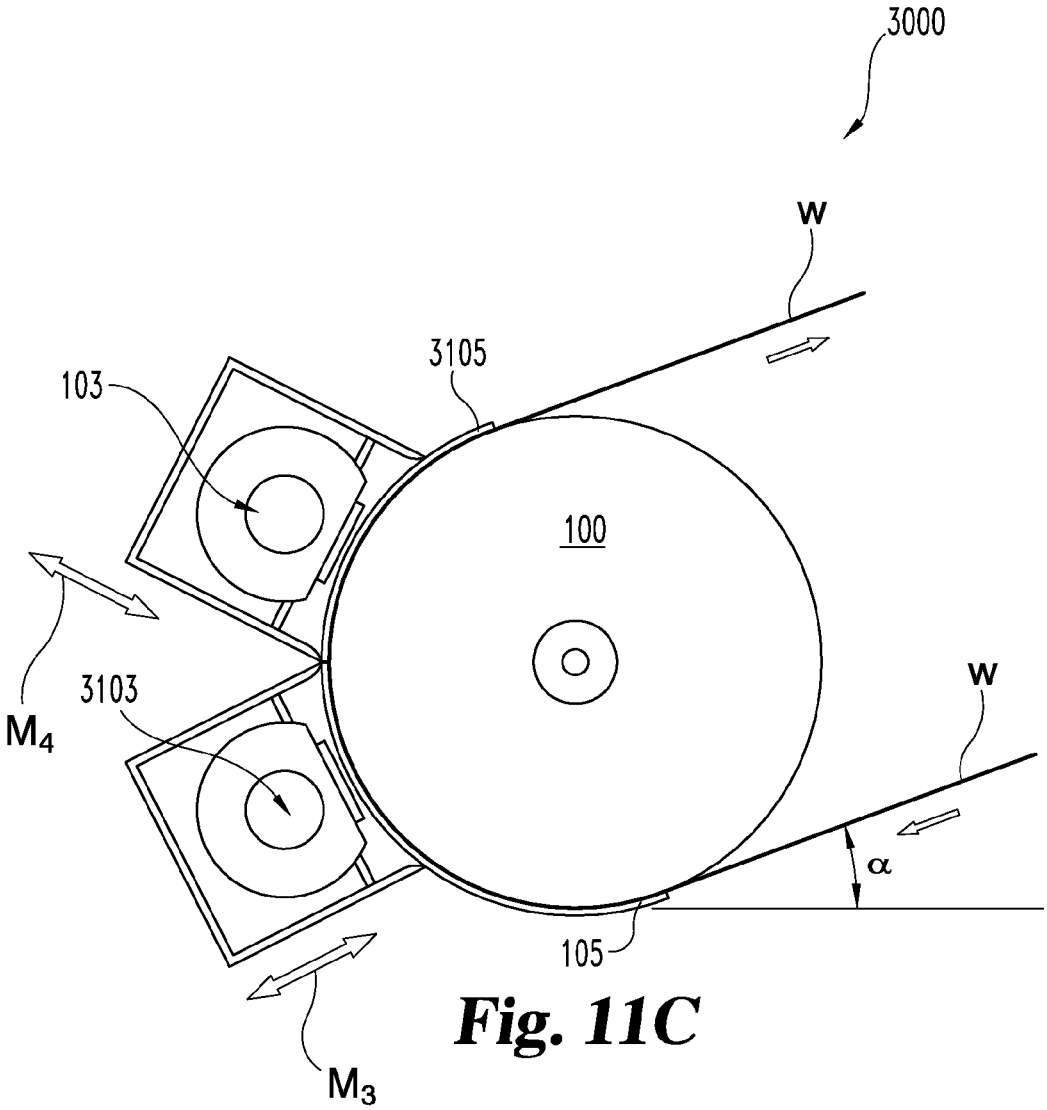
FIG. 11C is a further alternative example showing multiple electron beam emitters portions.

Another alternative arrangement is illustrated in FIG. 11C. This example shows apparatus 3000 with web W wrapped partially around roller 100 and may be exposed to electron beam emitter 3103 (upstream) and 103 (downstream). Emitters 103 and 3103 are generally adjacent on another, on the same half (180 degrees) of the roller (compare FIG. 11B where the emitters are generally across roller 100 from each other, on opposite halves of the roller). In this arrangement, for example, the multiple emitters 103 and 3103 may be within the same 180 degree arc of a circumference of roller 100. This facilitates the further option of having emitters 103 and 3103 mechanically jointed or monolithic with respect to each other, in a common emitter portion. The emitter portion with emitter 103 may include circumferential radiation shielding 105 (as previously discussed), and emitter 3103 may have circumferential radiation shielding 3105, which may be monolithic or, as shown, split. In such joined or monolithic arrangement, using forms of circumferential radiation shielding, roller 100 (an its roller portion) and emitters 103 and 3103, may be made movable with respect to each other between opened and closed positions (similar to movement $M_1$ illustrated in FIG. 11B). Optionally, in addition to the two beam emitters illustrated, 103 and 3103, a third, fourth and other electron beam emitters may be arrayed around one or more rollers, such as roller 100. Moreover, roller 100 may be augmented with one or more additional rollers within a reaction chamber, or in separate reaction chambers adjacent, with additional electron beam emitters associated with them. Note further that movement $M_3$ and/or movement $M_4$ may optionally be provided separately to allow one or more of the beam emitters to be moved between an open and closed position to allow operator access to the respective beam emitters.

Note further that various arrangements, with or without other rollers completely outside the reaction chamber, nonetheless the second surface of the web (bottom surface depicted in FIG. 11C) may be nonetheless free of contact with other rollers from the time it leaves an optional upstream depositor until after it is irradiated with electron beams while passing around roller 100. The apparatus of FIG. 11C may have one or more of the other optional features previously discussed and/or defined above.

The direction of movement of the web for each of the examples may be reversed. In such case, what constitutes upstream and downstream is correspondingly reversed. Also, the arrangement, sizes, relationships, and orientation of the rollers and emitters may be changed or inverted, such as for example, inverting the arrangements illustrated in FIGS. 11B and 11C, such that the web enters roller 100 from its top, side, bottom or otherwise, with or without uncured material, and in the case of a web with uncured material, with it on the top or bottom of the web.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. It is also contemplated that structures and features embodied in the present examples can be altered, rearranged, substituted, deleted, duplicated, combined, or added to each other.

What is claimed is:

1. An apparatus, comprising:

An electron beam emitter;

A reaction chamber adjacent said electron beam emitter and having radiation shielding for substantially containing or de-energizing radiation produced from electron beams;

A cylindrical roller having a portion of its surface cylindrical to enable a web to wrap partially around it within said reaction chamber, said roller further including radiation shielding to partially define said reaction chamber, wherein a part of said cylindrical surface is outside of said reaction chamber and in which there is a first groove or protrusion or brush engaging area encircling said cylindrical surface axially outboard of the position for a web to wrap around; and A first circumferential radiation shielding located in close proximity to and around a circumference of said roller's cylindrical surface and which has either a shape positioned near and substantially corresponding to said first groove or protrusion, or a brush to engage the brush engaging area to substantially contain or de-energize radiation produced from the electron beams.

2. The apparatus of claim 1 and further comprising a second groove or protrusion encircling said cylindrical surface axially outboard of the position for a web to wrap around but on the opposite end from said first groove or protrusion, and also comprising a second circumferential radiation shielding located in close proximity to and around a circumference of said roller's cylindrical surface and which has a shape positioned near and substantially corresponding to said second groove or protrusion to substantially contain or de-energize radiation produced from the electron beams and wherein said first and said second circumferential radiation shielding are an arc of a circumference less than or equal to about 180 degrees.

3. The apparatus of claim 1 in which said first circumferential radiation shielding comprises a tongue and groove interface near one end of said cylindrical roller for extending circumferentially around a portion of it.

4. The apparatus of claim 3 in which said tongue and groove interface includes a groove in said cylindrical surface of said roller.

5. The apparatus of claim 3 in which said groove has substantially sloping sides.

6. The apparatus of claim 3 in which said groove at its deepest point is laterally offset from its shallowest point.

7. The apparatus of claim 3 in which said groove is defined, at least in part, by a surface that tapers in a direction that is axial with respect to said roller.

8. The apparatus of claim 2 wherein the apparatus has a first, closed position wherein said roller is adjacent said beam emitter and wherein said beam emitter portion radiation shielding and said roller radiation shielding collectively define said reaction chamber; and, wherein the apparatus has a second, open position wherein said roller is moved away from said beam emitter allowing operator access to said beam emitter.

9. The apparatus of claim 3 wherein the apparatus has a first, closed position wherein said roller is adjacent said beam emitter and wherein said beam emitter portion radiation shielding and said roller radiation shielding collectively define said reaction chamber; and, wherein the apparatus has a second, open position wherein said roller is moved away from said beam emitter allowing operator access to said beam emitter.

10. The apparatus of claim 1 in which said roller is supported for rotation by at least one bearing located outside of said reaction chamber.

11. The apparatus of claim 10 additionally comprising a driver that engages said roller outside of said reaction chamber.

12. The apparatus of claim 1 in which said roller is the only roller for contacting a web that is at least partially within said reaction chamber.

13. The apparatus of claim 1 in which said roller is chilled by coolant fluid flowing into said roller.

14. The apparatus of claim 1 and further comprising:

A depositor of uncured material onto at least a portion of an opposite second side of said web upstream from said roller, Said web following a path from said depositor to said roller that is free of contact with other rollers contacting said uncured material on said second side of said web.

15. The apparatus of claim 1 wherein the apparatus has a first, closed position wherein said roller is adjacent said beam emitter and wherein said beam emitter portion radiation shielding and said roller radiation shielding collectively define said reaction chamber; and, wherein the apparatus has a second, open position wherein said roller is moved away from said beam emitter allowing operator access to said beam emitter.

16. The apparatus of claim 1 and further comprising:

Internal baffles which include radiation shielding, said baffles being within said reaction chambers that segment the inside of the reaction chamber into successive voids, at least some extending to a point near the surface of said roller that leaves space for the web to pass but limited area for radiation energy to pass from one void to the next, wherein successive voids provides for radiation to successively contact surfaces to reduce the radiation energy.

17. The apparatus of claim 8 in which said roller is supported for rotation by at least one bearing located outside of said reaction chamber.

18. The apparatus of claim 17 in which said roller is chilled by coolant fluid flowing into and out of said roller.

19. An apparatus, comprising:

An electron beam emitter;

A reaction chamber adjacent said electron beam emitter and having radiation shielding for substantially containing or de-energizing radiation produced from the electron beams;

A roller to enable a web to wrap partially around it within said reaction chamber, said roller further including radiation shielding to partially define said reaction chamber; and A web wrapped around said roller, wherein a first side of said web is facing said roller;

A depositor of uncured material onto at least a portion of an opposite second side of said web upstream from said roller, Said web following a path from said depositor to said roller that is free of contact between said uncured material on said second side of said web and another roller.

20. The apparatus of claim 19 in which the path between said depositor and said roller is substantially horizontal.

21. The apparatus of claim 19 in which the path between said depositor and said roller has an overall angular slope between −30 and 30 degrees.

22. The apparatus of claim 19 wherein said roller is the only roller at least partially within the reaction chamber, and in which the web contacts a second roller that is completely outside of said reaction chamber.

23. The apparatus of claim 22 in which downstream motion of the web after said roller passes outside of and under said reaction chamber.

24. The apparatus of claim 19 and further comprising circumferential radiation shielding located in close proximity to and around said roller and axially outboard of the web to substantially contain or de-energizing radiation produced from the electron beams.

25. The apparatus of claim 24 wherein the apparatus has a first, closed position wherein said roller is adjacent said beam emitter and wherein said beam emitter portion radiation shielding and said roller radiation shielding collectively define said reaction chamber; and, wherein the apparatus has a second, open position wherein said roller is moved away from said beam emitter allowing operator access to said beam emitter.

26. The apparatus of claim 25 in which said roller is supported for rotation by at least one bearing located outside of said reaction chamber.

27. The apparatus of claim 19 and further comprising: internal baffles which include radiation shielding, said baffles being within said reaction chambers that segment the inside of the reaction chamber into successive voids, at least some extending to a point near the surface of said roller that leaves space for the web to pass but limited area for radiation energy to pass from one void to the next, wherein successive voids provides for radiation to successively contact surfaces to reduce the radiation energy.

28. The apparatus of claim 19 in which said roller is a cylindrical roller that is chilled by a liquid coolant fluid flowing into said cylindrical roller.

29. The apparatus of claim 24 in which said first circumferential radiation shielding comprises a tongue and groove interface near one end of said cylindrical roller for extending circumferentially around a portion of it.

30. The apparatus of claim 28 and further comprising circumferential radiation shielding around said roller which near one end of said cylindrical roller comprises a tongue and groove interface for extending circumferentially around a portion of it.

31. An apparatus, comprising:

An electron beam emitter;

A reaction chamber adjacent said electron beam emitter and having radiation shielding for substantially containing or de-energizing radiation produced from the electron beams;

A cylindrical roller having a portion of its surface cylindrical to enable a web to wrap partially around it within a reaction chamber, said roller further including radiation shielding to partially define said reaction chamber, wherein a part of said cylindrical surface is outside of said reaction chamber;

Internal baffles which include radiation shielding, said baffles being within said reaction chambers that segment the inside of the reaction chamber into successive voids, at least some extending to a point near the surface of said roller that leaves space for the web to pass but limited area for radiation energy to pass from one void to the next, wherein successive voids provides for radiation to successively contact surfaces to reduce the radiation energy.

32. The apparatus of claim 31 in which there within said reaction chamber has at least two baffled voids on upstream side of the web location and at least two baffled voids on the downstream side of the web location, with said electron beam emitter positioned in between the upstream and downstream sides.

33. The apparatus of claim 32 in which said electron beam emitter has a window through which its beam is emitted and one of said baffles between voids is substantially parallel in orientation to the plane of the window on said electron beam emitter.

34. The apparatus of claim 33 in which said plane of said window is substantially vertical.

35. The apparatus of claim 31 wherein the apparatus has a vertical window between said electron beam emitter and the web and has a first, closed position wherein said roller is adjacent said beam emitter and wherein said beam emitter portion radiation shielding and said roller radiation shielding collectively define said reaction chamber; and, wherein the apparatus has a second, open position wherein said roller is moved away from said beam emitter allowing operator access to said beam emitter.

36. An apparatus, comprising:

A beam emitter portion including an electron beam emitter and having radiation shielding for substantially containing or de-energizing radiation produced from electron beams;

A roller portion including a roller to enable a web to wrap partially around it within a reaction chamber, said roller further including radiation shielding to partially define said reaction chamber;

wherein the apparatus has a first, closed position wherein said roller is adjacent said beam emitter and wherein said beam emitter portion radiation shielding and said roller radiation shielding collectively define said reaction chamber; and, wherein the apparatus has a second, open position wherein said roller and said beam emitter are separated from each other substantially horizontally in a direction aligned with a radii of said roller, allowing operator access to said beam emitter.

37. The apparatus of claim 36 wherein the apparatus has a generally vertical window between said electron beam emitter and the web.

38. The apparatus of claim 36 and further comprising at least one track to guide movement of said beam emitter portion and said roller portion together and apart from each other.

39. The apparatus of claim 36 wherein said roller comprises a cylindrical roller with circumferential radiation shielding around it in an arc of a circumference less than or equal to about 180 degrees.

40. The apparatus of claim 36 and further comprising circumferential radiation shielding around said roller comprises a tongue and groove interface near one end of said cylindrical roller for extending circumferentially around a portion of it.

41. The apparatus of claim 36 in which said roller is a cylindrical roller that is chilled by liquid coolant fluid flowing into said cylindrical roller.

42. The apparatus of claim 38 in which said roller is a cylindrical roller that is chilled by coolant fluid flowing into and out of said cylindrical roller and further comprising circumferential radiation shielding around said roller which comprises a tongue and groove interface near one end of said cylindrical roller for extending circumferentially around a portion of it.

43. The apparatus of claim 42 wherein the apparatus has a generally vertical window between said electron beam emitter and the web.

44. The apparatus of claim 39 wherein said roller is the only roller at least partially within the reaction chamber, and in which the web contacts a second roller that is completely outside of said reaction chamber.

* * * * *